US007547215B1

(12) United States Patent
Mark et al.

(10) Patent No.: US 7,547,215 B1
(45) Date of Patent: Jun. 16, 2009

(54) ROUND CONNECTOR WITH SPRING HELIX

(75) Inventors: Gregory Mark, Cambridge, MA (US); Andrew Wallace, Cambridge, MA (US)

(73) Assignee: Methode Electronics, Inc., Chicago, IL (US)

( * ) Notice: Subject to any disclaimer, the term of this patent is extended or adjusted under 35 U.S.C. 154(b) by 0 days.

(21) Appl. No.: 12/023,950

(22) Filed: Jan. 31, 2008

(51) Int. Cl.
*H01R 12/00* (2006.01)

(52) U.S. Cl. ..... 439/66

(58) Field of Classification Search ..... 439/840–841, 439/268, 264, 259, 843, 66, 86, 690, 825, 439/654

See application file for complete search history.

(56) References Cited

U.S. PATENT DOCUMENTS 3,530,422 A 9/1970 Goodman
3,665,370 A 5/1972 Hartmann
5,154,626 A * 10/1992 Watson ..... 439/268
5,634,801 A 6/1997 Johnson
5,913,687 A 6/1999 Rathburn
6,659,778 B2 * 12/2003 Li ..... 439/66
7,077,662 B2 * 7/2006 Sweetland et al. ..... 439/67
2005/0159028 A1 * 7/2005 Sweetland et al. ..... 439/67

* cited by examiner

*Primary Examiner*—Edwin A. Leon
(74) *Attorney, Agent, or Firm*—Barnes & Thornburg LLP

(57) ABSTRACT

Apparatuses and methods of manufacturing woven electrical connectors is disclosed. In one embodiment, the connector is formed with a continuous wire having adjacent sections with passageways formed from the wire through which loading elements may be inserted. In some embodiments, the loading elements include spring band clips and/or helical spring coils.

7 Claims, 21 Drawing Sheets

ROUND CONNECTOR WITH SPRING HELIX

BACKGROUND

1. Field

The present invention is directed to electrical connectors and in particular to woven electrical connectors and methods used to manufacture them.

2. Discussion of Related Art

Components of electrical systems sometimes need to be interconnected using electrical connectors to provide an overall, functioning system. These components may vary in size and complexity, depending on the type of system and many require connections to power sources. Examples of such power connectors are shown in U.S. Patent Application Publication No. 2004/0214454, presently assigned to the assignee of this presentation and hereby incorporated by reference in its entirety.

SUMMARY

In one aspect, the invention relates to a multi-contact electrical connector. The multi-contact electrical connector includes a conductive wire defining a plurality of adjacent sections including a first section and an adjacent second section, the first section having a first portion of the first section comprising a plurality of peaks and valleys and a second portion of the first section continuous with the first portion of the first section comprising a plurality of valleys and peaks, the second portion of the first section is looped back adjacent the first portion of the first section whereby the plurality of peaks and valleys of the first portion of the first section align with the plurality of valleys and peaks, respectively, of the second portion of the first section to define a plurality of passageways in the first section of a plurality of sections, wherein the second portion of the first section is continuous with a first portion of the adjacent second section, the first portion of the second section comprising a plurality of peaks and valleys and a second portion of the second section continuous with the first portion of the second section comprising a plurality of valleys and peaks, the second portion of the second section is looped back adjacent the first portion of the second section whereby the plurality of peaks and valleys of the first portion of the second section align with the plurality of valleys and peaks, respectively, of the second portion of the second section to define a plurality of passageways in the second section of the plurality of sections; and a loading element disposed within the plurality of passageways to bias a plurality of peaks into contact with a mating connector when connected thereto.

In another aspect, the invention relates to an electrical connector. The electrical connector includes a conductive wire defining a plurality of adjacent sections including a first section and an adjacent second section, the first section having a first portion of the first section comprising a plurality of peaks and valleys and a second portion of the first section continuous with the first portion of the first section comprising a plurality of valleys and peaks, the second portion of the first section is looped back adjacent the first portion of the first section whereby the plurality of peaks and valleys of the first portion of the first section align with the plurality of valleys and peaks, respectively, of the second portion of the first section to define a plurality of passageways in the first section of a plurality of sections, wherein the plurality of sections are disposed about a circumference to form a substantially cylindrical shape and wherein adjacent sections are longitudinally offset from one another is such that each of the passageways of one section are offset from each of the passageways of an adjacent section; and a helically shaped biasing element disposed within the plurality of passageways to bias a plurality of peaks into contact with a mating connector when connected thereto.

In a different aspect, the invention relates to an electrical connector. The electrical connector includes a conductive wire defining a plurality of adjacent sections including a first section and an adjacent second section, the first section having a first portion of the first section comprising a plurality of peaks and valleys and a second portion of the first section continuous with the first portion of the first section comprising a plurality of valleys and peaks, the second portion of the first section is looped back adjacent the first portion of the first section whereby the plurality of peaks and valleys of the first portion of the first section align with the plurality of valleys and peaks, respectively, of the second portion of the first section to define a plurality of passageways in the first section of a plurality of sections, wherein the plurality of sections are disposed about an arc circumference to form a substantially arcuate shape having the plurality of passageways disposed about an arc; and an arcuate shaped biasing element disposed within adjacent passageways to bias a plurality of peaks into contact with a mating connector when connected thereto.

In a further aspect, the invention relates to a method of forming an electrical connector. The method includes providing a conductive wire, the wire having a first section and a second section; plastically deforming the first section of the wire with a forming tool to define at least one first section passageway; with the same wire, plastically deforming the second section of the wire with the forming tool to define at least one second section passageway; arranging the first and second sections to be laterally adjacent one other such that the at least one first section passageway generally aligns with the at least one second section passageway; inserting a loading element through the passageways of adjacent sections.

Various embodiments of the present invention provide certain advantages. Not all embodiments of the invention share the same advantages and those that do may not share them under all circumstances.

Further features and advantages of the present invention, as well as the structure of various embodiments of the present invention are described in detail below with reference to the accompanying drawings.

BRIEF DESCRIPTION OF DRAWINGS

The accompanying drawings are not intended to be drawn to scale. In the drawings, each identical or nearly identical component that is illustrated in various figures is represented by a like numeral. For purposes of clarity, not every component may be labeled in every drawing. In the drawings.

DETAILED DESCRIPTION

Aspects of the invention provide an electrical connector that may overcome the disadvantages of prior art connectors. The present invention is also directed to methods of manufacturing connectors. As discussed in the above-referenced U.S. Patent Application Publication No. 2004/0214454, connectors for providing power to an electrical component include a set of conductive wires formed with peaks and valleys resulting in passageways through which a loading fiber is disposed. The loading fiber can be tensioned using any suitable tensioning arrangement so that the conductive wires can be biased into engagement with a connector. As shown in schematically in FIGS. 1A and 1B, elastic non-conductive elements 88 may be tensioned in the direction of arrows 93A and 93B, to provide a predetermined tension in a non-conductive element, which in turn may provide a predetermined contact force between the conductors 90 and the mating contact 96.

Figure 1A:
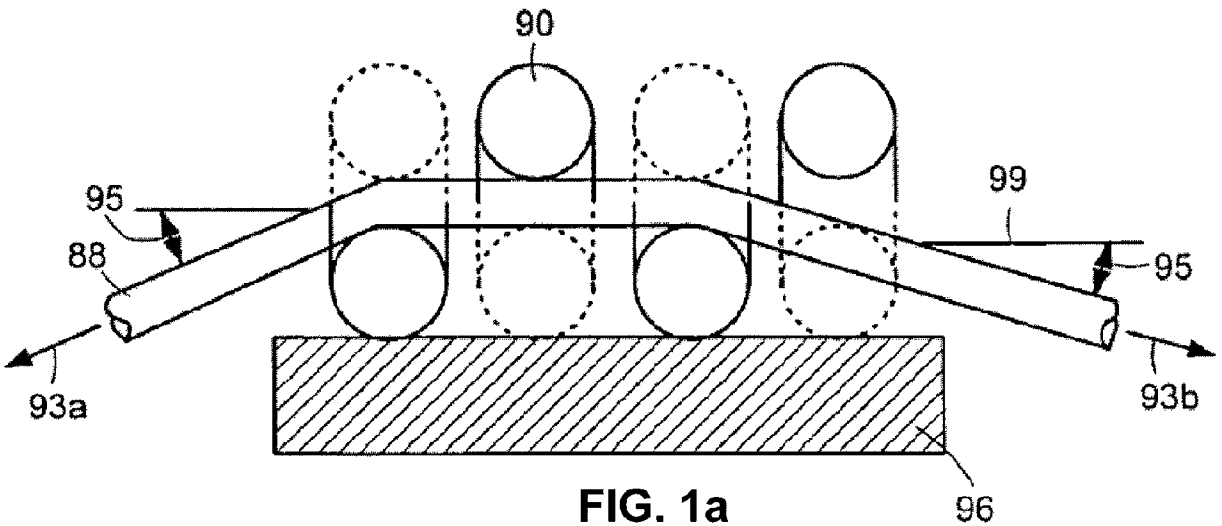
FIGS. 1*a* and 1*b* are schematic enlarged cross-sectional views of a portion of a connector according to one illustrative embodiment.
Figure 1B:
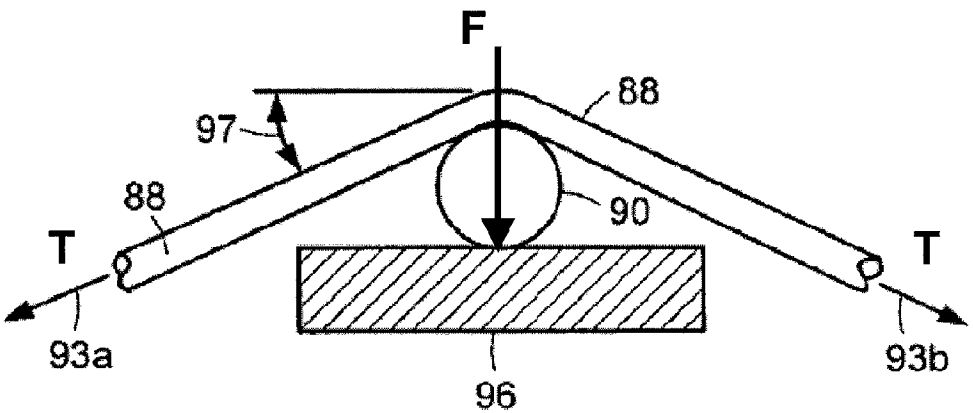

In the example illustrated in FIG. 1*a*, the non-conductive element 88 may be tensioned such that the non-conductive element 88 makes an angle 95 with respect to a plane 99 of the mating conductor 96, so as to press the conductors 90 against the mating contact 96. In this embodiment, more than one conductor 90 may be making contact with the mating conductor 96. Alternatively, as illustrated in FIG. 1*b*, a single conductor 90 may be in contact with any single mating conductor 96, providing the electrical contact as discussed above. Similar to the previous example, the non-conductive element 88 is tensioned in the directions of the arrows 93*a* and 93*b*, and makes an angle 97 with respect to the plane of the mating contact 96, on either side of the conductor 90.

It is to be appreciated that the conductors and non-conductive and insulating fibers making up a weave may be extremely thin, for example having diameters in a range of approximately 0.0001 inches to approximately 0.020 inches, and thus a very high density connector may be possible using the woven structure. Because the woven conductors are locally compliant, as discussed above, little energy may be expended in overcoming friction, and thus the connector may require only a relatively low normal force to engage a connector with a mating connector element. This may also increase the useful life of the connector as there is a lower possibility of breakage or bending of the conductors occurring when the connector element is engaged with the mating connector element.

As discussed herein, the utilization of conductors being woven or intertwined with loading elements can provide particular advantages for electrical connector systems. Designers are constantly struggling to develop (1) smaller electrical connectors and (2) electrical connectors which have minimal electrical resistance. The woven connectors described herein can provide advantages in both of these areas. The total electrical resistance of an assembled electrical connector is generally a function of the electrical resistance properties of the male-side of the connector, the electrical resistance properties of the female-side of the connector, and the electrical resistance of the interface that lies between these two sides of the connector. The electrical resistance properties of both the male and female-sides of the electrical connector are generally dependent upon the physical geometries and material properties of their respective electrical conductors. The electrical resistance of a male-side connector, for example, is typically a function of its conductor's (or conductors') cross-sectional area, length and material properties. The physical geometries and material selections of these conductors are often dictated by the load capabilities of the electrical connector, size constraints, structural and environmental considerations, and manufacturing capabilities.

Another critical parameter of an electrical connector is to achieve a low and stable separable electrical resistance interface, i.e., electrical contact resistance. The electrical contact resistance between a conductor and a mating conductor in certain loading regions can be a function of the normal contact force that is being exerted between the two conductive surfaces. As can be seen in FIG. 1*b*, the normal contact force F of a woven connector is a function of the tension T exerted by the loading element 88, the angle 97 that is formed between the loading element 88 and the contact mating surface of the mating conductor 96, and the number of conductors 90 of which the tension T is acting upon. As the tension T and/or angle 97 increase, the normal contact force F also increases. Moreover, for a desired normal contact force F there may be a wide variety of tension T/angle 97 combinations that can produce the desired normal contact force. Although the mating surface 96 is shown as generally flat, the surface can be any suitable shape, such as a curve for example, where the mating connector is formed as a plug having a round cross-section.

Figure 2A:
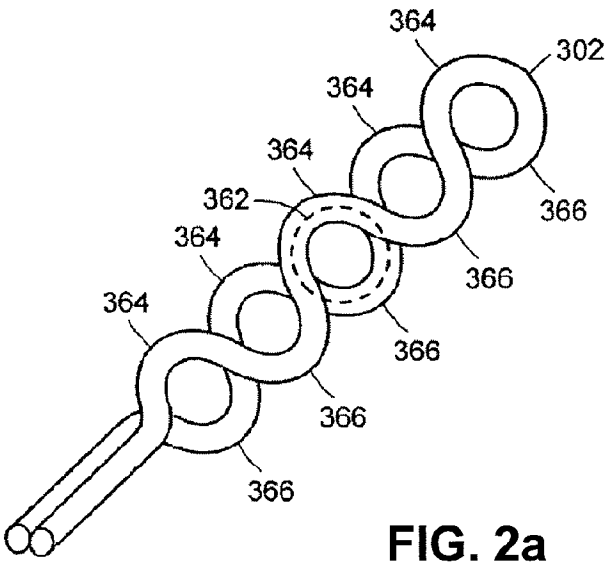
FIGS. 2*a*-2*c* are perspective views of portions of woven connector embodiments.
Figure 2B:
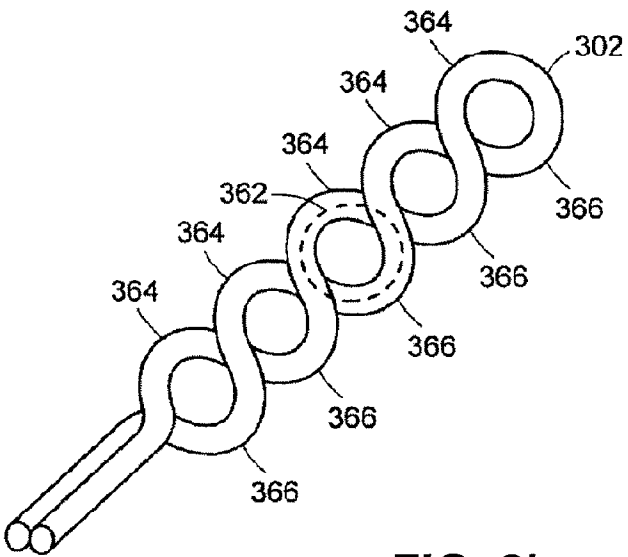
Figure 2C:
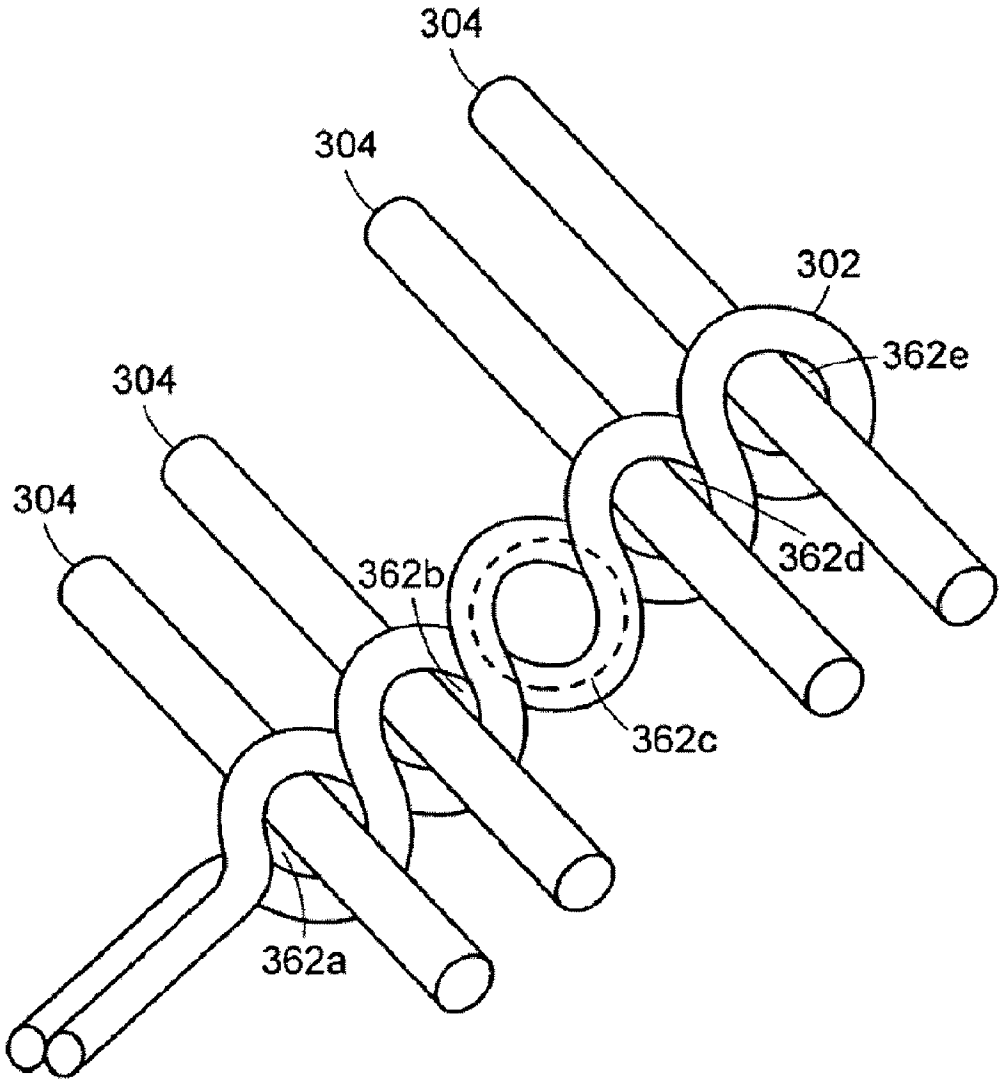

FIGS. 2*a*-*c* illustrate some exemplary embodiments of how conductor(s) 302 can be woven onto loading elements 304. The conductor 302 of FIGS. 2*a*-*c* is self-terminating and, while only one conductor 302 is shown, persons skilled in the art will readily appreciate that additional conductors 302 will usually be present within the depicted embodiments. FIG. 2*a* illustrates a conductor 302 that is arranged as a straight weave. The conductor 302 forms a first set of peaks 364 and valleys 366, wraps back upon itself (i.e., is self-terminated) and then forms a second set of peaks 364 and valleys 366 that lie adjacent to and are offset from the first set of peaks 364 and valleys 366. A peak 364 from the first set and a valley 366 from the second set (or, alternatively, a valley 366 from the first set and a peak 364 from the second set) together can form a loop 362. Loading elements 304 can be located within (i.e., be engaged with) the loops 362. FIG. 2*b* illustrates a conductor 302 that is arranged as a crossed weave. The conductor 302 of FIG. 2*b* forms a first set of peaks 364 and valleys 366, wraps back upon itself and then forms a second set of peaks 364 and valleys 366 which are interwoven with, and are offset from, the first set of peaks 364 and valleys 366. Similarly, peaks 364 from the first set and valleys 366 from the second set (or, alternatively, valleys 366 from the first set and peaks 364 from the second set) together can form loops 362, which may be occupied by loading elements 304. As shown, the cross-weave alternates at every peak and valley. However, the present invention is not limited in this respect as the cross-weave may occur at every other (or some other suitable multiple) peak and valley.

FIG. 2*c* depicts a self-terminating conductor 302 that is cross woven onto four loading elements 304. The conductor 302 of FIG. 2*c* forms five loops 362*a-e*. In certain exemplary embodiments, a loading element(s) 304 is located within each of the loops 362 that are formed by the conductors 302. However, not all loops 362 need to be occupied by a loading element 304. FIG. 2*c*, for example, illustrates an exemplary embodiment where loop 362*c* does not contain a loading element 304. It may be desirable to include unoccupied loops 362 within certain conductor 302—loading element 304 weave embodiments so as to achieve a desired overall weave stiffness (and flexibility). Having unoccupied loops 362 within the weave may also provide improved operations and manufacturing benefits. When the weave structure is mounted to a base, for example, there may be a slight misalignment of the weave relative to the mating conductor. This misalignment may be compensated for due to the presence of the unoccupied loop 362. Thus, by utilizing loops that are unoccupied, compliance of the weave structure to ensure better conductor/mating conductor conductivity while keeping the weave tension to a minimum may be achieved. Utilizing unoccupied loops 362 may also permit greater tolerance allowances during the assembly process.

Figure 3:
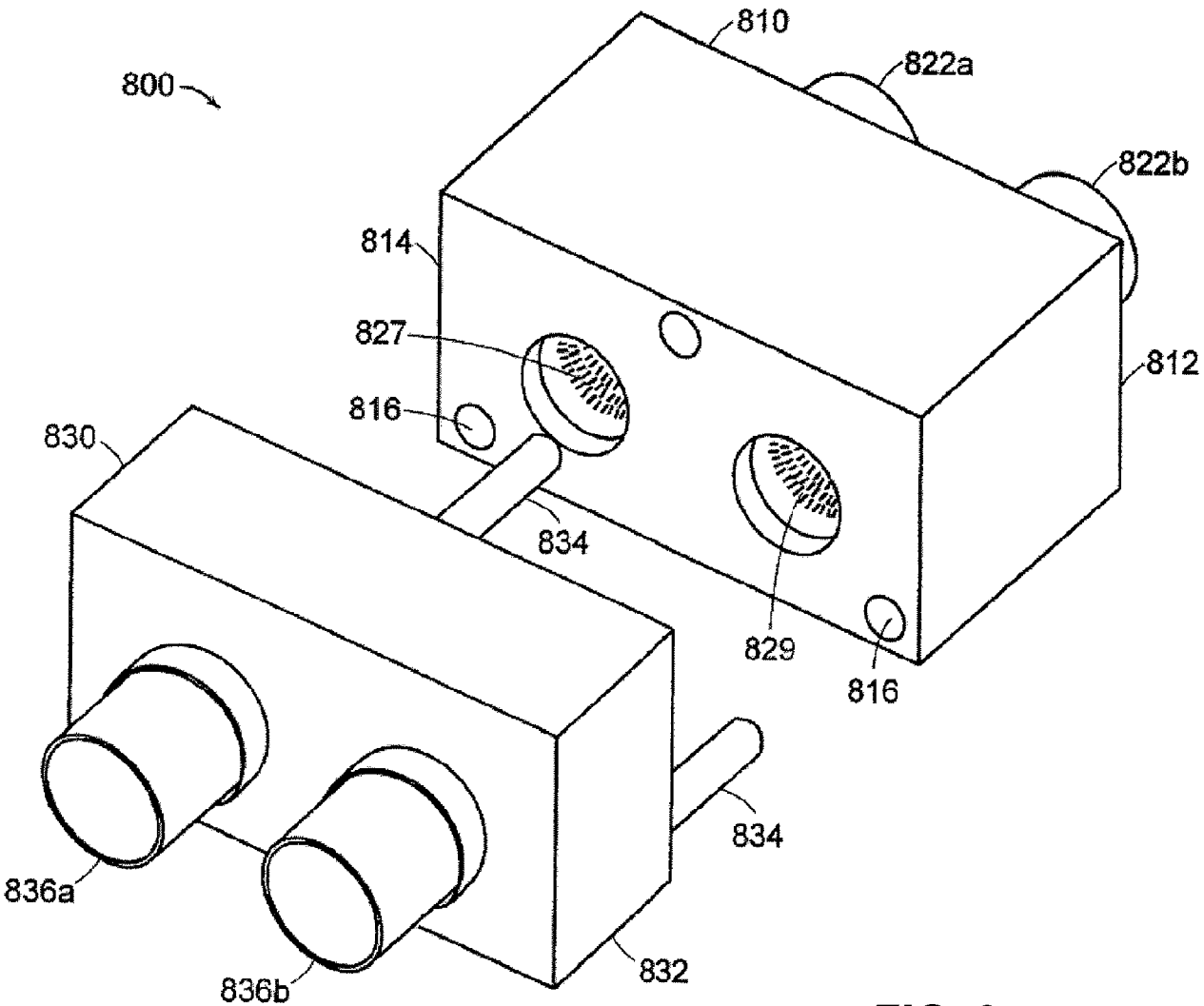
FIG. 3 is a perspective view of a woven power connector according to one illustrative embodiment.

Tests of a wide variety of conductor 302—loading element 304 weave geometries can be performed to determine the relationship between normal contact force 310 and electrical contact resistance. Referring to FIG. 3, the total electrical resistance of various woven connector embodiments, as represented on y-axis 314, can be determined over a range of normal contact forces, as represented on x-axis 316. As represented in FIG. 3, the general trend 318 indicates that as the normal contact force (in Newtons (N)) increases, the contact resistance component of the total electrical resistance (in milli-ohms (mOhms)) generally decreases. Persons skilled in the art will readily recognize, however, that the decrease in contact resistance only extends over a certain range of normal contact forces; any further increases over a threshold normal contact force will produce no further reduction in electrical contact resistance. In other words, trend 318 tends to flatten out as one moves further and further along the x-axis 316.

From the data of FIG. 3, for example, one can then determine a normal contact force (or range thereof) that is sufficient for minimizing a woven connector's electrical contact resistance. As persons skilled in the art will readily appreciate, the vast majority of the conventional electrical connectors that are available today operate with normal contact forces ranging from about 0.35 to 0.5 N or higher. As is evident by the data represented in FIG. 3, by generating multiple contact points on conductors 302 of a woven connector system, very light loading levels (i.e., normal contact forces) can be used to produce very low and repeatable electrical contact resistances. The data of FIG. 3, for example, can demonstrate that for many of the woven connector embodiments, normal contact forces of between approximately 0.020 and 0.045 N may be sufficient for minimizing electrical contact resistance. Such normal contact forces thus represent an order of magnitude reduction in the normal contact forces of conventional electrical connectors.

Additionally, in some power connector embodiments, each conductor 302 of a connector is in electrical contact with the adjacent conductor(s) 302. Providing multiple contact points along each conductor 302 and establishing electrical contact between adjacent conductors 302 further ensures that the multi-contact woven power connector embodiments are sufficiently load balanced. Moreover, the geometry and design of the woven connector prohibit a single point interface failure. If the conductors 302 located adjacent to a first conductor 302 are in electrical contact with mating conductors 306, then the first conductor 302 will not cause a failure (despite the fact that the contact points of the first conductor 302 may not be in contact with a mating conductor 306) since the load in the first conductor 302 can be delivered to a mating conductor 306 via the adjacent conductors 302.

In certain exemplary embodiments, the conductors 302 can include copper or copper alloy (e.g., C110 copper, C172 Beryllium Copper alloy) wires having diameters between 0.0002 and 0.010 inches or more. Alternatively, the conductors may be flat ribbon wires having comparable rectangular cross-section dimensions. The conductors 302 may also be plated to prevent or minimize oxidation, e.g., nickel plated or gold plated. Acceptable conductors 302 for a given woven connector embodiment should be identified based upon the desired load capabilities of the intended connector, the mechanical strength of the candidate conductor 302, the manufacturing issues that might arise if the candidate conductor 302 is used and other system requirements, e.g., the desired tension T. The conductors 302 of the power circuit 512 exit a back portion of the housing 530 and may be coupled to a termination contact or other conductor element through which power can be delivered to the power connector 500. As is discussed in more detail below, the loading elements 304 of the power circuit 512 are capable of carrying or providing a tension T that ultimately translates into a contact normal force being asserted at the contact points of the conductors 302. In exemplary embodiments, the loading elements 304 may include or be formed of nylon, fluorocarbon, polyaramids and paraaramids (e.g., Kevlar®, Spectra®, Vectran®), polyamids, conductive metals and natural fibers, such as cotton, for example, coupled to a biasing element. In most exemplary embodiments, the loading elements 304 have diameters (or widths) of about 0.010 to 0.002 inches. However, in certain embodiments, the diameter/widths of the loading elements 304 may be as low as 18 microns when high performance engineered fibers (e.g., Kevlar) are used. In one embodiment, the loading elements 304 are formed of a non-conducting material.

Figure 4A:
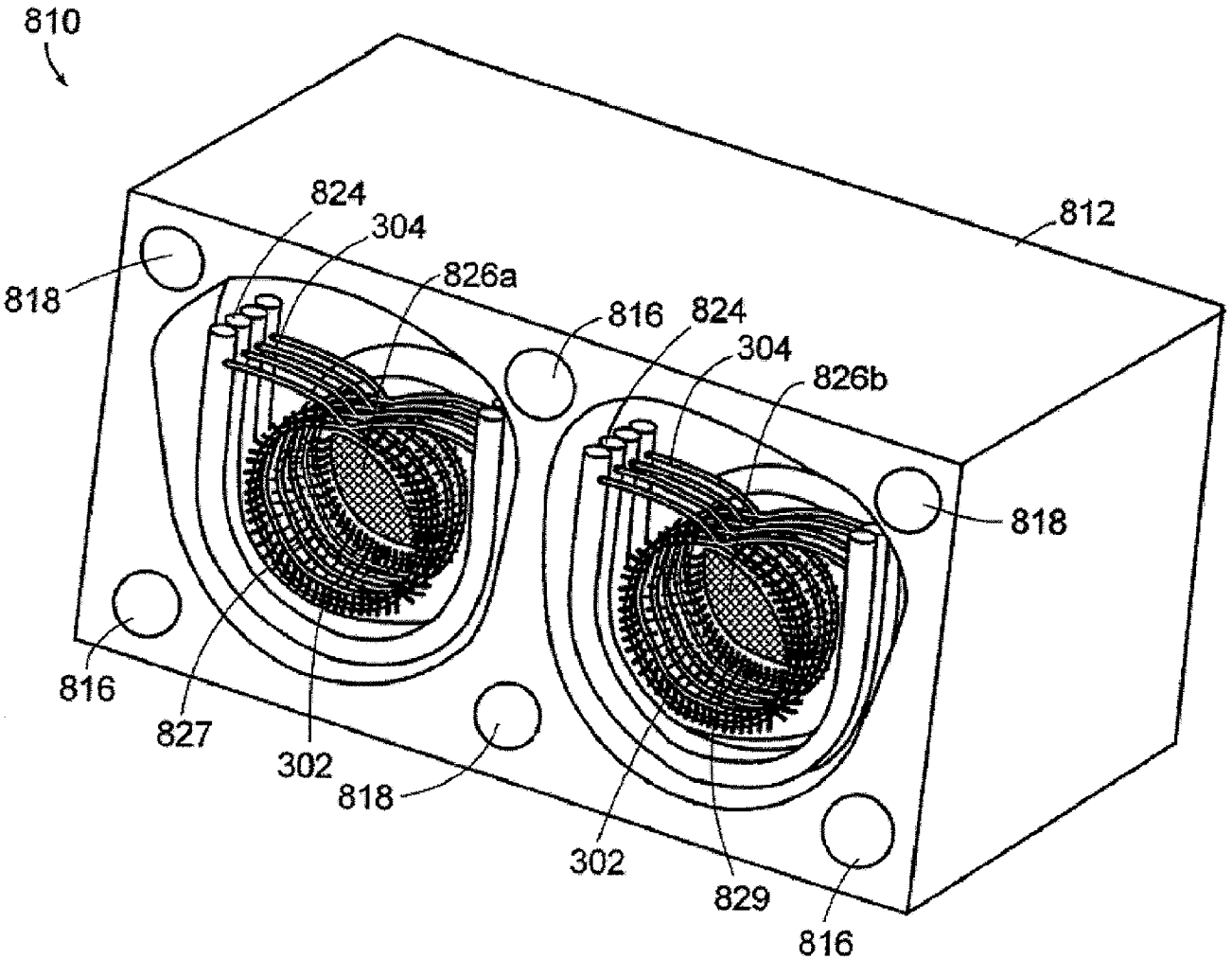
FIGS. 4*a* and 4*b* are perspective views of the woven connector element of FIG. 3 with and without a faceplate according to one illustrative embodiment.
Figure 4B:
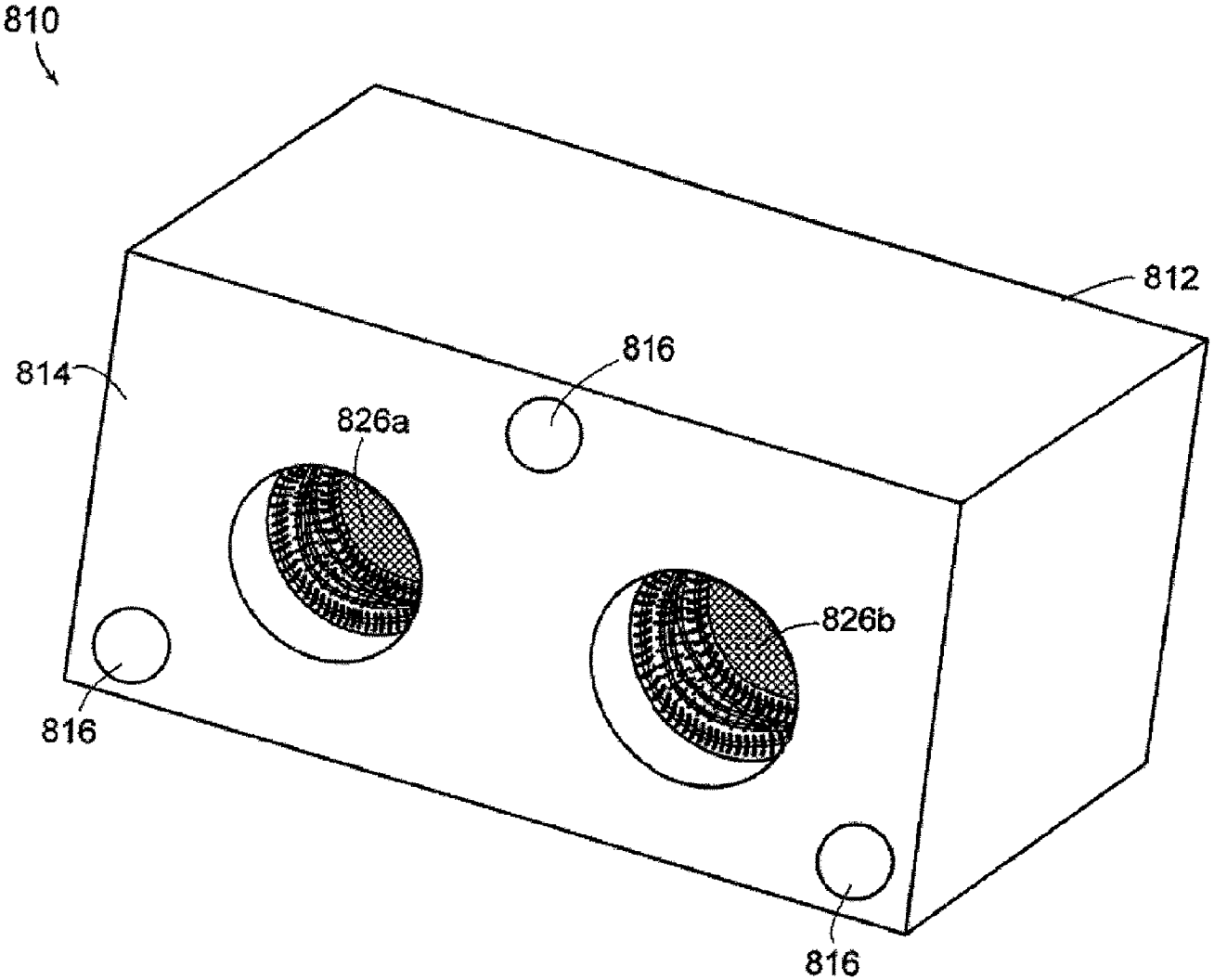
Figure 5:
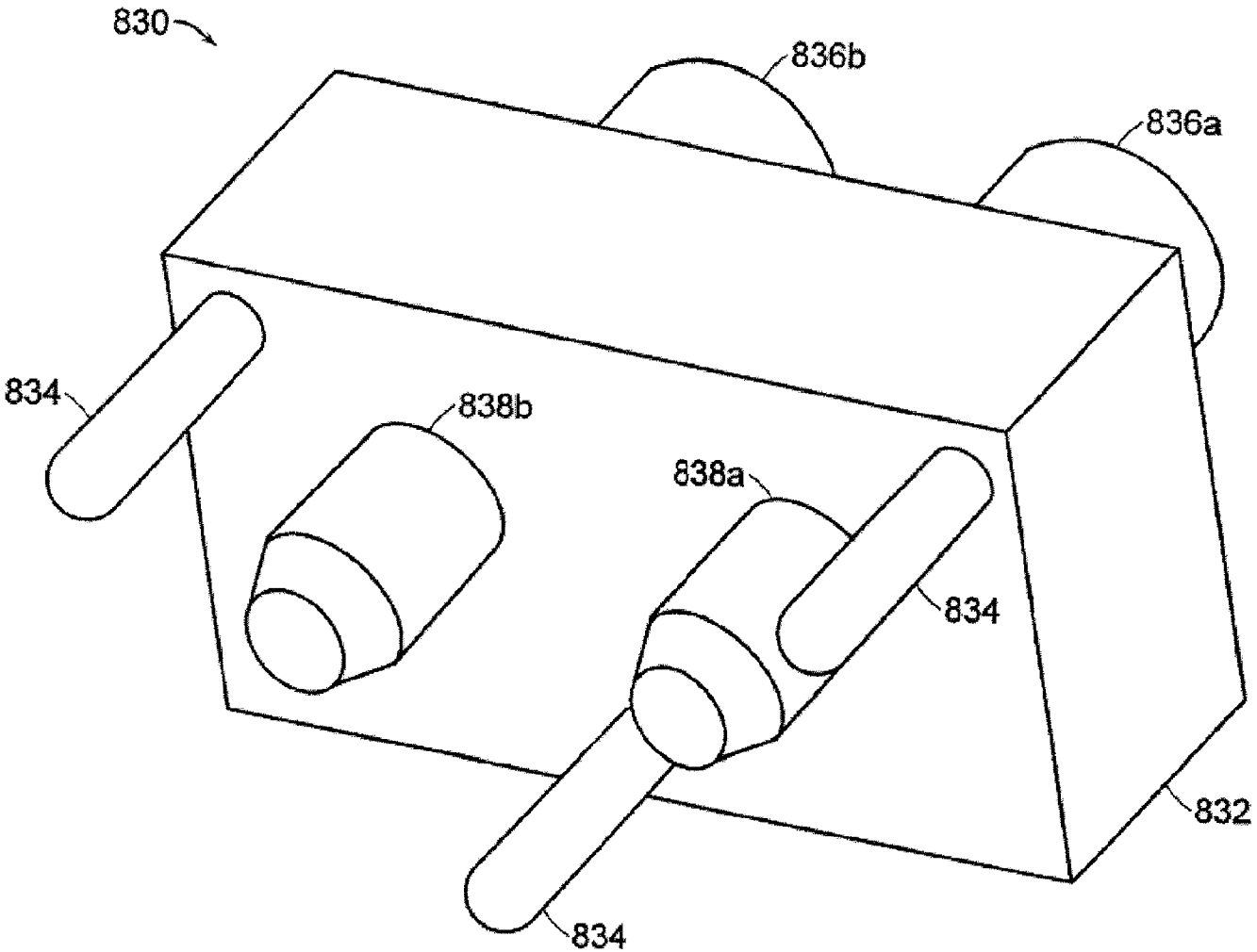
FIG. 5 is a perspective view of a mating connector element for use with the connector element of FIG. 3 according to one illustrative embodiment.

FIGS. 3-5 depict an exemplary embodiment of a multi-contact woven power connector. Referring to FIG. 3, power connector 800 includes a woven connector element 810 and a mating connector element 830. The woven connector element 810 comprises a housing 812, a faceplate 814, a power circuit 827, a return circuit 829 and termination contacts 822*a*, 822*b*. The power circuit 827 and return circuit 829 terminate at termination contacts 822*a*, 822*b*, respectively, which are located on the backside of the woven connector element 810. Alignment holes 816 facilitate the mating of the mating connector element 830 to the woven connector element 810 and are disposed within the faceplate 814 and the housing 812. Mating connector element 830 comprises a housing 832, alignment pins 834, mating conductors 838*a*, 838*b* (as shown in FIG. 5) and termination contacts 836*a*, 836*b*. Mating conductors 838*a*, 838*b* terminate at termination contacts 836*a*, 836*b*, respectively, which are located on the backside of the mating connector element 830.

The woven connector element 810 of the power connector 800 is shown in greater detail in FIGS. 4*a*-4*b*. FIG. 4*a* shows the woven connector element 810 with the faceplate 814 removed, while FIG. 4*b* shows the woven connector element 810 with the faceplate 814 installed. As seen in FIG. 4*a*, in addition to the alignment holes 816, woven connector element 810 also includes holes 818 which can facilitate the installation of the faceplate 814 onto the housing 812. The woven connector element 810 further includes several loading elements 304 and several tensioning springs 824. In exemplary power connector 800, different sets of loading elements 304 and tensioning springs 824 are utilized on the power circuit 827 and return circuit 829 sides of the woven connector element 810. The power circuit 827 comprises several conductors 302 which are woven onto several loading elements 304 in accordance with the teachings of the present disclosure. The return circuit 829 similarly comprises several conductors 302. The conductors 302 of the return circuit 829 are woven onto several loading elements 304. In one embodiment, the conductors 302 of the power circuit 827 and the return circuit 829 are self-terminating. In the depicted exemplary power circuit 827, the conductors 302 of the power circuit 827 are each woven onto four loading elements 304 while the conductors 302 of the return circuit 829 are each woven onto four different loading elements 304. The ends of the loading elements 304 of the power circuit 827 side of the woven connector element 810 are coupled, i.e., attached, to tensioning springs 824. In certain exemplary embodiments, the tensioning springs 824 of the woven connector element 810 surround the outside of the weaves that are made from conductor 302 and loading element 304. In other embodiments, however, the tension springs 824 need not surround the weaves. In a preferred embodiment, each loading element 304 is coupled to a separate independent tension spring 824, e.g., a first loading element 304 is coupled to a first tensioning spring 824, a second loading element 304 is coupled to a second tensioning spring 824, etc. The ends of the loading elements 304 of the return circuit 829 side of the woven connector element 810 are similarly coupled to independent tensioning springs 824. By independently coupling the loading elements 304 to separate tensioning springs 824, the power connector 800's electrical connection capabilities become more redundant and resistant to failure.

As depicted in the exemplary embodiment of FIGS. 4*a*-*b*, the conductors 302 of the power circuit 827, when woven onto the corresponding loading elements 304, form a woven tube having a space 826*a* disposed therein. When woven onto the corresponding loading elements 304, the conductors 302 of the return circuit 829 form a woven tube having a space 826*b* disposed therein. In most exemplary embodiments, the cross-sections of the woven tubes are symmetrical. In certain exemplary embodiments, such as woven connector element 810, for example, the cross-sections of the woven tubes are circular.

FIG. 5 shows the mating connector element 830 of FIG. 3 from an opposite view. Referring to FIG. 5, the mating connector element 830 includes mating conductors 838*a*, 838*b*. Mating conductors 838*a*, 838*b* terminate at termination contacts 836*a*, 836*b*, respectively, which are located on the backside of the mating connector element 830. In certain exemplary embodiments, the mating conductors 838*a*, 838*b* are rod-shaped (e.g., pin-shaped) and have contact mating surfaces that are circumferentially disposed along the mating conductors 838*a*, 838*b*. The mating conductors 838*a*, 838*b* are appropriately sized (e.g., length, width, diameter, etc.) so that, upon engaging the mating conductor element 830 to the woven connector element 810 (or vice versa), electrical connections between the conductors 302 of the power circuit 827 and the return circuit 829 and the contact mating surfaces of the mating conductors 838*a*, 838*b*, respectively, can be established. In certain exemplary embodiments, the diameters of the mating conductors 838 range from approximately 0.01 inches to approximately 0.4 inches.

As has been discussed herein, contact between the conductors 302 and the contact mating surfaces of the mating conductors 838 can be established and maintained by the loading elements 304. For example, when mating conductor 838*a* of the mating conductor element 830 is inserted into the space 826*a* of the power circuit 827 (of the woven connector element 810), the mating conductor 838*a* causes the weave of the conductors 302 and loading elements 304 of the power circuit 827 to expand in a radial direction. In doing so, the weave expands to a sufficient degree that the ends of the loading elements 304 which, in this example, are attached to the tensioning springs 824 are pulled closer together. This forces the tensioning springs 824 to deform elastically and tension is produced in the loading elements 304 which thus results in the desired normal contact forces being exerted at the contact points of the conductors 302. Similarly, when mating conductor 838*b* of the mating conductor element 830 is inserted into the space 826*b* of the return circuit 829, the mating conductor 838*b* causes the conductor 302/loading element 304 weave of the return circuit 829 to expand in a radial direction. In the power connector 800 embodiment, the tensile loads within the loading elements 304 are generated and maintained by the elastic deformation of the tensioning springs 824; when the weave expands, the loading elements 304 are pulled by the tensioning springs 824, and thus are placed in tension. However, as will become apparent below, in certain embodiments, the connector systems do not need to utilize tensioning springs, spring mounts, spring arms, etc. to generate and maintain the tensile loads within the loading elements, as the loading elements (which may be referred to as biasing elements) themselves can provide the requisite force.

When the mating connector element 830 is being engaged with the woven connector element 810, the faceplate 814 of the woven connector element 810 may assist in properly aligning the mating conductors 838*a*, 838*b* with the spaces 826*a*, 826*b*, respectively, of the woven connector element 810. The faceplate 814 also serves to protect the weaves of the woven connector element 810. To further facilitate the insertion of the mating conductors 838*a*, 838*b* into spaces 826*a*, 826*b*, the ends of the mating conductors 838*a*, 838*b* may be chamfered.

The use of rod-shaped mating conductors 838 with corresponding tube-shaped weaves allows the power connector 800 to become more space efficient, in terms of number of electrical contact points per unit volume, for example, than is generally possible with other types of multi-contact woven power connectors. The utilization of this arrangement, moreover, allows for the compact incorporation of tensioning springs that surround the weaves, which provides the longest length spring with the largest deflection under load for such a small package area. Furthermore, since the radius of the rod-shaped mating conductors 838*a*, 838*b* can be made quite small, as compared to the woven power connector systems having other shapes, the tension needed within loading elements 304 to generate the desired normal contact force at the contact points can thus be lowered. For these reasons, power connector 800, for example, can achieve a power density that is about twice that of the power connectors 500, 600 while maintaining the same low insertion force and number of multiple redundant contacts.

Power connector 800 includes a power circuit 827 and a return circuit 829. In accordance with the teachings of the present disclosure, however, in other embodiments the woven connector element may only comprise power circuits. Thus, in some embodiments, the return circuit 829 of woven connector element 810, for example, is replaced with a power circuit 827. In yet other embodiments, the woven connector element may include three or more power circuits. Such embodiments may also further include one or more return circuits. By having more than one power circuit being located within the woven connector element, power can be transferred across the power connector in a distributed fashion. By using a multiple-power circuit connector, the individual loads being transferred across each power circuit of the connector can be lowered (as compared to a single power circuit embodiment) while maintaining the same total power load capabilities across the connector.

Figure 6:
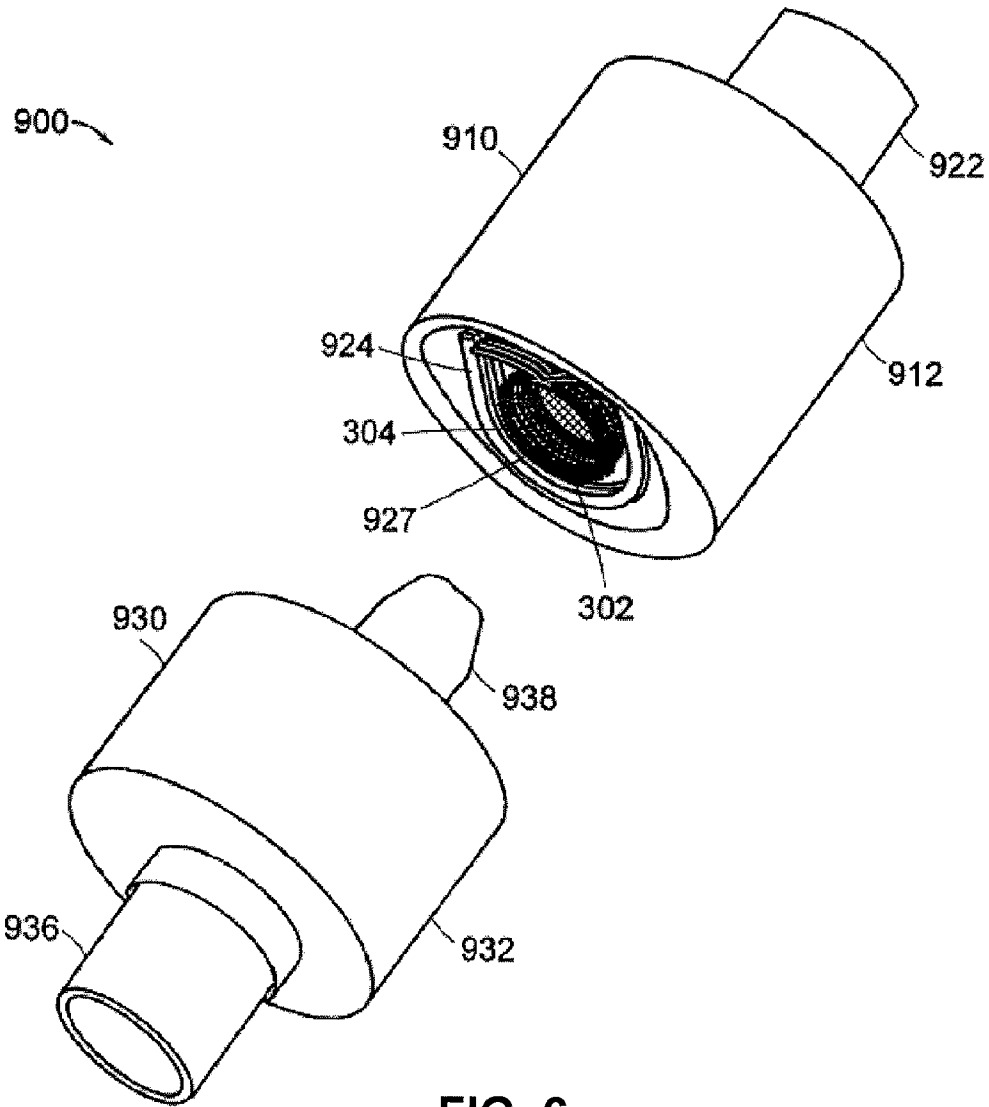
FIG. 6 is a perspective view of yet another woven power connector according to one illustrative embodiment.

FIG. 6 depicts a further exemplary embodiment of a multi-contact woven power connector in accordance with the teachings of the present disclosure. The power connector 900 of FIG. 6 includes a woven connector element 910 and a mating connector element 930. The woven connector element 910 comprises a housing 912, an optional faceplate (not shown), several conductors 302, loading elements 304 and tensioning springs 924, and a termination contact 922. The conductors 302 form a power circuit 827 that terminates at the termination contact 922 that is located on the backside of the woven connector element 910. The ends of the loading elements 304 are attached to the tensioning springs 924. In a preferred embodiment, each loading element 304 is attached to a separate independent tension spring 924. Conductors 302 are woven onto the loading elements 304 to form a woven tube having a space disposed therein. However, unlike the woven connector element 810 of connector 800, woven connector element 910 only includes a single weave, e.g., woven tube. Thus, the woven connector element 910 only has a single power circuit 927; woven connector element 910 does not include a return circuit.

Mating connector element 930 includes a housing 932, a mating conductor 938 and a termination contact 936. Mating conductor 938 terminates at termination contact 936, which is located on the backside of the mating connector element 930. The mating conductor 938 is rod-shaped and has a contact mating surface circumferentially disposed along its length. The mating conductor 938 is appropriately sized so that when the mating conductor element 930 is coupled to the woven connector element 910, electrical connections between the conductors 302 of the power circuit 927 and the contact mating surfaces of the mating conductors 938 can be established. Specifically, when mating conductor 938 of the mating conductor element 930 is inserted into the center space of the woven tube of the woven connector element 910, the mating conductor 938 causes the weave of the conductors 302 and loading elements 304 to expand in a radial direction. In doing so, the weave expands to a sufficient degree that the ends of the loading elements 304 which are attached to the tensioning springs 924 are pulled closer together. This forces the tensioning springs 924 to deform elastically and tension is produced in the loading elements 304. With the appropriate amount of tension being present within the loading elements 304, the desired normal contact forces are exerted at the contact points of the conductors 302 that make up the power circuit 927.

In certain embodiments, power connector 900 having a single power circuit 927 without a return circuit, could be used as a "power cable" to "bus bar" connector. Persons of ordinary skill in the art, however, will readily recognize that power connector 900 may be used for a wide variety of other connector applications.

The woven electrical connectors can be manufactured through a process including the acts of 1) forming the first set of strands so as to produce passageways and 2) inserting loading elements into the passageways. The formed strands may be terminated to a conductor, and the ends of the loading elements may be terminated. Although in the exemplary process the steps are performed in this order, they may be performed in different orders, as the invention is not limited in this respect. In some embodiments, additional processing may also be performed. For instance, some embodiments include the additional acts of loading the connector into a housing, and quality testing the construction of the connector. In other embodiments some of these acts may be eliminated altogether.

One exemplary embodiment of forming the strands to produce a power connector is disclosed in the above referenced U.S. Patent Application Publication No. 2004/0214454. Briefly, the strands are formed as individual elements in various forming fixtures. The individual formed strands or segments, as shown in FIGS. 2*a*-2*c* may then be woven with a loading element to form a power connector. However, as will be explained below, the strands or segments may be formed from a continuous wire where the segments are thus joined together in a continuous fashion. Thus, in one embodiment, individual strands 302 (see FIGS. 2*a*-2*c*) are not required to be formed and trimmed, as woven electrical connectors may be made up of a single relatively long wire that incorporates adjacent segments together as one continuous piece. In this respect, it may be advantageous to form a woven electrical connector out of a continuous wire for added reliability in processing, as manufacturing challenges may arise when forming and orienting individual strands 302 separately in a suitable way. In addition, a common step of forming woven electrical connectors includes coating the wire with gold and/or any other suitable conductive material. In this respect, individually positioning separate strands 302 for plating may be a cumbersome task. As a result, with a woven electrical connector formed from a continuous wire, the conductive wireform comes "pre-assembled" as the adjacent segments are already connected to one another. A single plating step may be performed subsequently after the wire is appropriately formed, allowing for a relatively uniform coat thickness for all of the adjacent segments. Regarding forming the continuous wire in a suitable configuration of adjacent segments, several embodiments concerning the process of forming will be presented below.

Figure 7A:
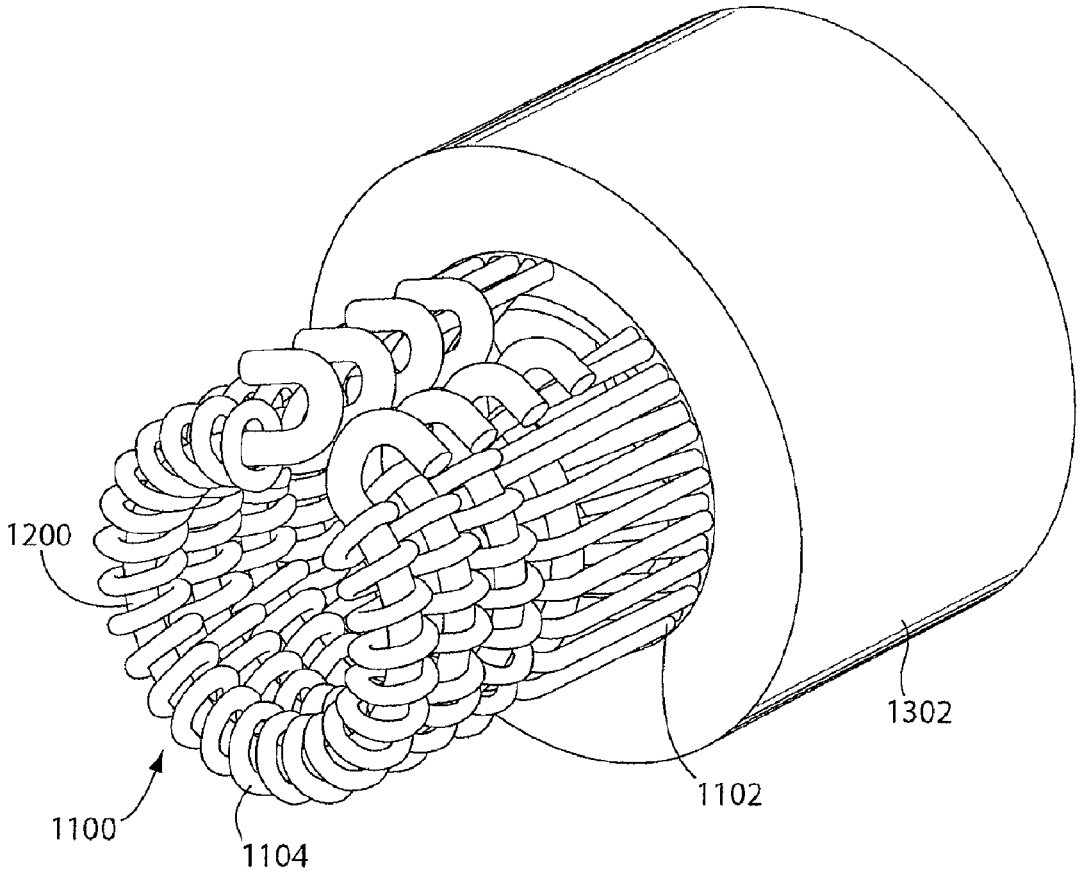
FIGS. 7*a* and 7*b* are perspective views of alternative woven power connectors.
Figure 7B:
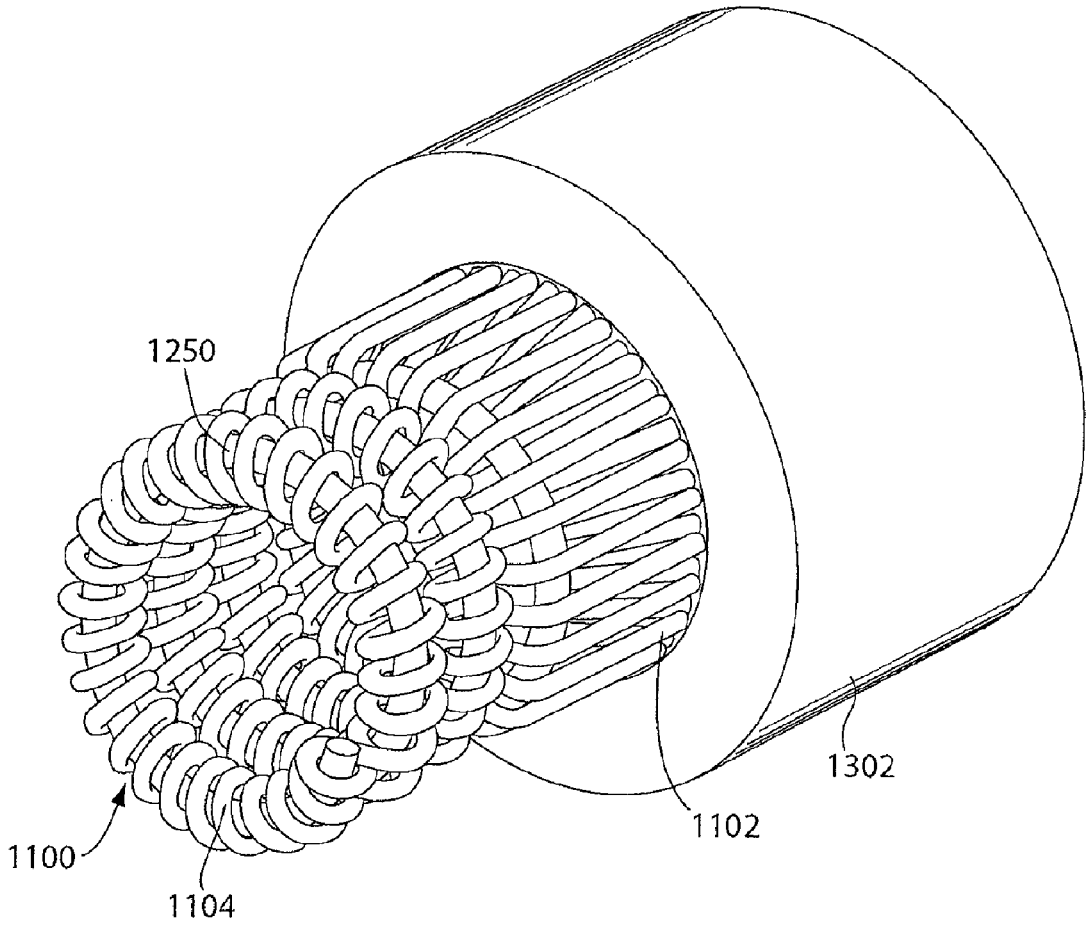

FIGS. 7*a* and 7*b* show illustrative embodiments of the connector incorporating various loading elements. The continuous wire 1100 may have curved regions 1104 that are configured as passageways to house an appropriate loading element. Furthermore, the continuous wire may have elongated regions 1102 that may serve to interact with the connection ferrule 1302. In this regard, elongated regions 1102 may have a mating surface for a connection as well as a firm mechanical attachment to be made.

Figures 8A, 8B, 8C:
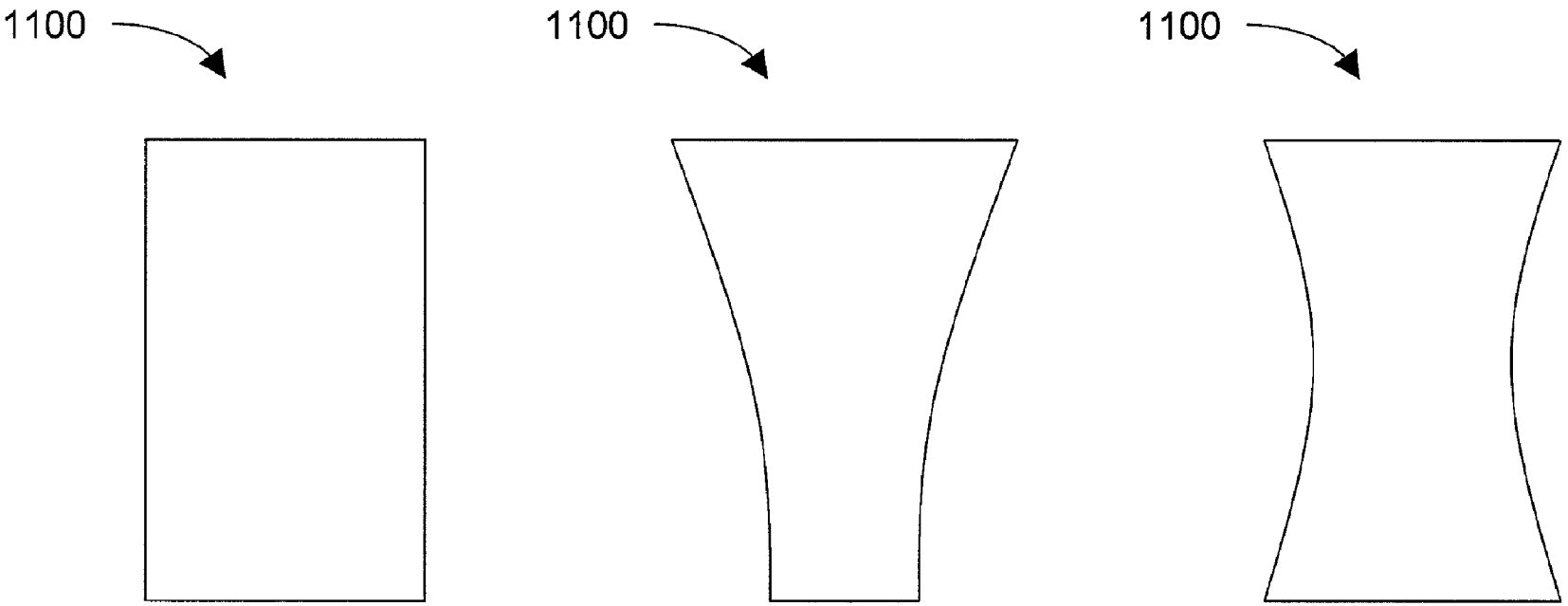
FIGS. 8*a*-8*c* are schematic cross-sectional views of various shaped connectors.

In different embodiments, the shape of the continuous wire 1100, as inserted into the ferrule, may vary. In some embodiments, the formed connector may take on a cylindrical shape, as shown in FIG. 8*a*. In other embodiments as depicted in FIG. 8*b*, the entrance to the connector that is further away from the ferrule 1302 may have a larger diameter than at a location closer towards the ferrule 1302. In further embodiments, the formed connector may take on an hour glass shape, as shown in FIG. 8*c*.

Figure 9A:
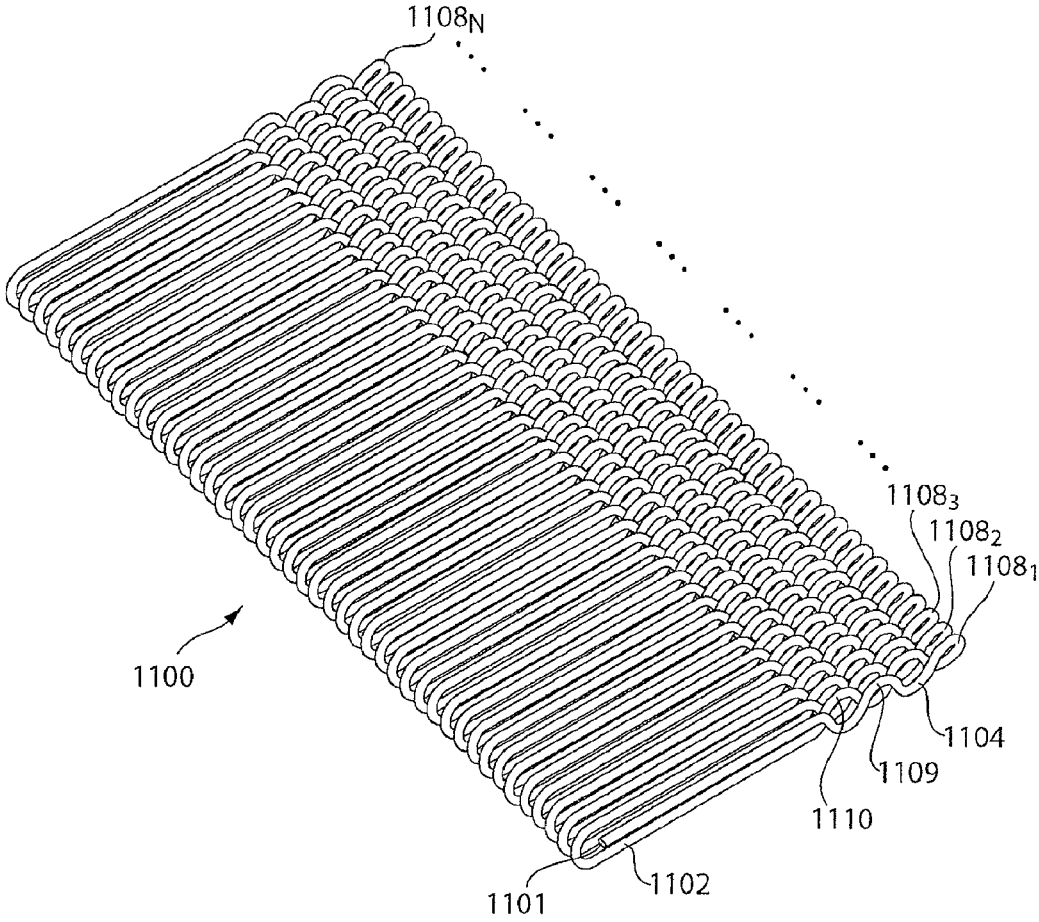
FIG. 9*a* is a perspective view of a continuous wireform in a planar configuration according to one illustrative embodiment.
Figure 9B:
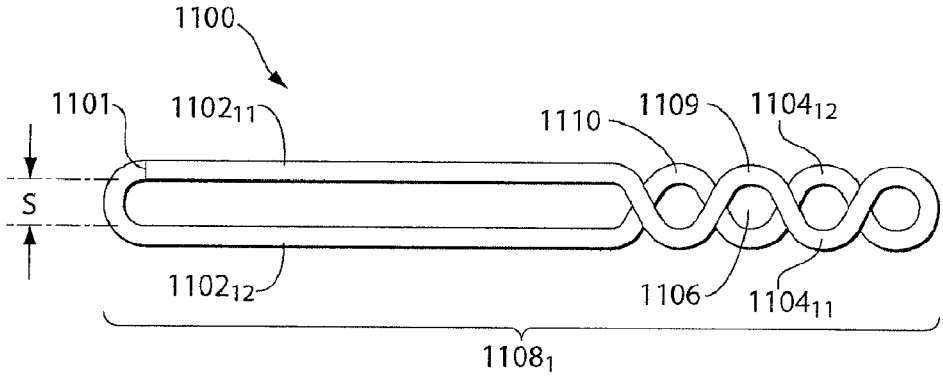
FIG. 9*b* is a side view of the continuous wireform of FIG. 9*a;*

FIGS. 9*a* and 9*b* show one illustrative embodiment of a continuous wire 1100 prior to engagement with a biasing element or ferrule. The continuous wire 1100 is made up of adjacent sections $\mathbf{1108}_1$, $\mathbf{1108}_2$, . . . , $\mathbf{1108}_N$ that together are formed from a single conductive wire with each segment including two portions 1109 and 1110 that are positioned directly adjacent to one another and aligned such that a passageway may be formed through the curved regions 1104 of each portion.

FIG. 9*a* depicts a perspective view of a continuous wire 1100 that shows several sections $\mathbf{1108}_1$, $\mathbf{1108}_2$, . . . , $\mathbf{1108}_N$ that are also directly adjacent to one another. In this regard, the passageways formed by the curved regions 1104 of each portion are made longer with every section that is placed directly adjacent to another section. Beginning end 1101 of section $\mathbf{1108}_1$ of continuous wire 1100 is also depicted in FIG. 9*a*.

FIG. 9*b* shows a side plan view of continuous wire 1100 with only one section $\mathbf{1108}_1$, made up of two portions 1109 and 1110, being visible along with beginning end 1101. In various embodiments, each portion 1109 and 1110 of each section 1108 of the continuous wire 1100 may have an elongated region 1102 and a curved region 1104. In further embodiments, the curved region 1104 may form a number of peaks and valleys and the elongated region 1102 may be substantially straight. As shown in FIG. 9*b*, section $\mathbf{1108}_1$ is made up of portion 1109 and portion 1110. Portion 1109 includes curved region $\mathbf{1104}_{11}$ and elongated region $\mathbf{1102}_{11}$. Portion 1110 also includes curved region $\mathbf{1104}_{12}$ and elongated region $\mathbf{1102}_{12}$. Curved region $\mathbf{1104}_{11}$ of portion 1109 may have a number of peaks and valleys that extend into a relatively straight elongated region $\mathbf{1102}_{11}$ which provides a mating surface for ferrule 1302. The continuous wire 1100 then bends around to form portion 1110 adjacent to portion 1109. Portion 1110 may include elongated region $\mathbf{1102}_{12}$ which provides a mating surface for ferrule 1302, extending into curved region $\mathbf{1104}_{12}$, which also has a number of valleys and peaks.

As depicted in FIG. 9*b*, the elongated region $\mathbf{1102}_{12}$ of section 1110 may be spaced a distance S from elongated region $\mathbf{1102}_{11}$ of portion 1109. In addition, valleys and peaks of curved region $\mathbf{1104}_{12}$ of portion 1110 may align with the peaks and valleys of curved region $\mathbf{1104}_{11}$ of portion 1109, respectively, to form any suitable number of passageways 1106 through the continuous connector 1100. In the embodiment shown in FIGS. 9*a* and 9*b*, four passageways 1106 extend straight through the connector 1100 in a direction substantially perpendicular to the formed wire. It should be understood that any suitable number of passageways 1106 may be formed with curved regions 1104 of continuous wire 1100. In this regard, continuous wire 1100 may be formed into a substantially cylindrical shape such that sections $\mathbf{1108}_1$ and $\mathbf{1108}_N$ may be positioned in close proximity to one another. As a result, passageways 1106 may be connected to one another to form a circular path. As previously described, it may be possible to insert a biasing element into each of the passageways as desired.

In another aspect of the present invention, peaks and valleys may be shaped with any suitable degree of curve. In some embodiments, peaks and valleys may be curved in an undulating fashion as in a sinusoidal shape as revealed by FIG. 9*b* for curved regions $\mathbf{1104}_{11}$ and $\mathbf{1104}_{12}$. In other embodiments, peaks and valleys may be formed with right angles in a step shape type fashion, or may include sharp transitions in the form of a "V" and/or a "A".

In various embodiments, continuous wire 1100 may be left flat with sections adjacent to one another, as shown in FIG. 9*a*. In further embodiments, continuous wire 1100 may be rolled into a substantially cylindrical shape, as depicted in FIGS. 7*a* and 7*b*, with sections also adjacent to one another.

Figure 9C:
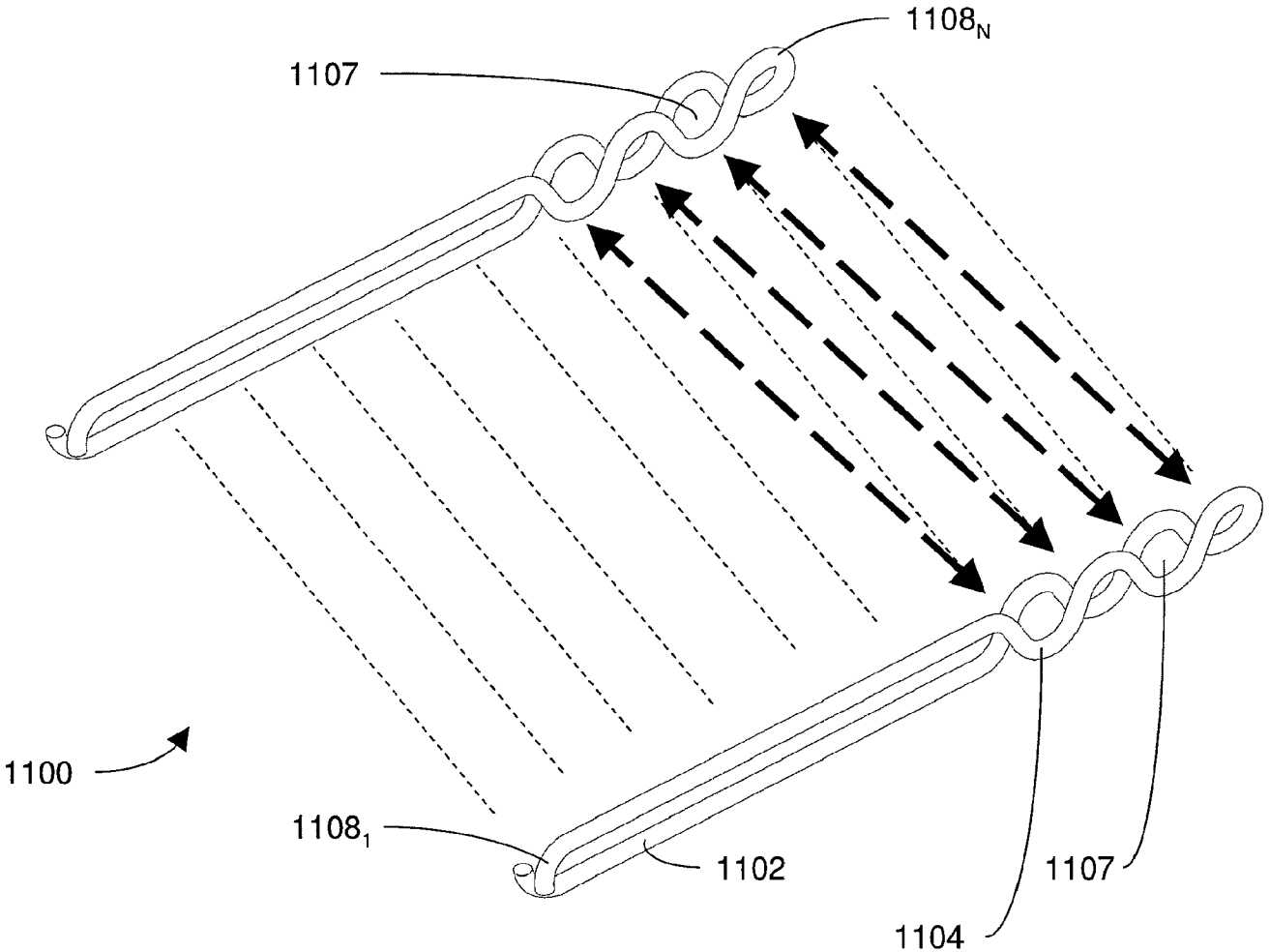
FIG. 9*c* is a perspective schematic view of the continuous wireform in an offset planar configuration.

In more illustrative embodiments, as shown in FIG. 9*c*, passageways 1107 may not extend in a direction substantially perpendicular to the formed wire, as adjacent sections $\mathbf{1108}_1$, . . . , $\mathbf{1108}_N$ may be offset relative to one another so that passageways 1107 may extend in a direction that makes an appropriate angle with the formed wire. In FIG. 9*c*, perpendicular to the formed wire is defined according to the direction parallel to the thin dotted lines provided. In this regard, when continuous wire 1100 is in a planar shape, a passageway 1107 may been seen as making a non-perpendicular angle with the formed wire.

Alternatively, when rolled into a substantially cylindrical shape with sections $\mathbf{1108}_1$ and $\mathbf{1108}_N$ positioned in close proximity adjacent to one another, a passageway 1107 may be seen as a spiral shape. In FIG. 9*c*, when in a planar configuration, passageways 1107 run along thick dashed lines with double arrows. As a result, it may be possible to insert a biasing element shaped as a helical coil through the passageways 1107. In various non-limiting embodiments, any number of passageways 1107 may be present in continuous wire 1100. Indeed, it is possible for only one passageway to be present in continuous wire 1100.

In forming the continuous wire 1100 as shown in FIGS. 9*a* and 9*b*, various embodiments will now be described herein for how to manipulate a long conductive wire into a suitable shape with appropriately formed sections with passageways running through as described previously. In many cases, shapes may be formed and the wire may be wrapped in a suitable manner and sequence. In some embodiments, shapes are formed and the wire is wrapped simultaneously. In other embodiments, shapes are formed first and the wire is subsequently wrapped. In further embodiments, the wire is wrapped and shapes are subsequently formed.

In one illustrative embodiment of a process where there continuous wire 1100 may be formed, shapes may be formed in conjunction with the wire being wrapped. In this regard, a spring or wire forming machine may be used with a servomechanism for multi-axial control. Typical wire forming machines incorporate a rotor for winding the wire as desired along with using machine operated arms that contain die components that are customized for cutting, shaping, and forming wires with high precision. One example of an appropriate spring forming machine for forming continuous wire 1100 includes the Simco CNC-620 machine. As a wire controllably slides out of a feed tube, the machine may perform a variety of discrete bending operations that allow for a well-defined continuous wire 1100 form to be produced.

Figure 10A:
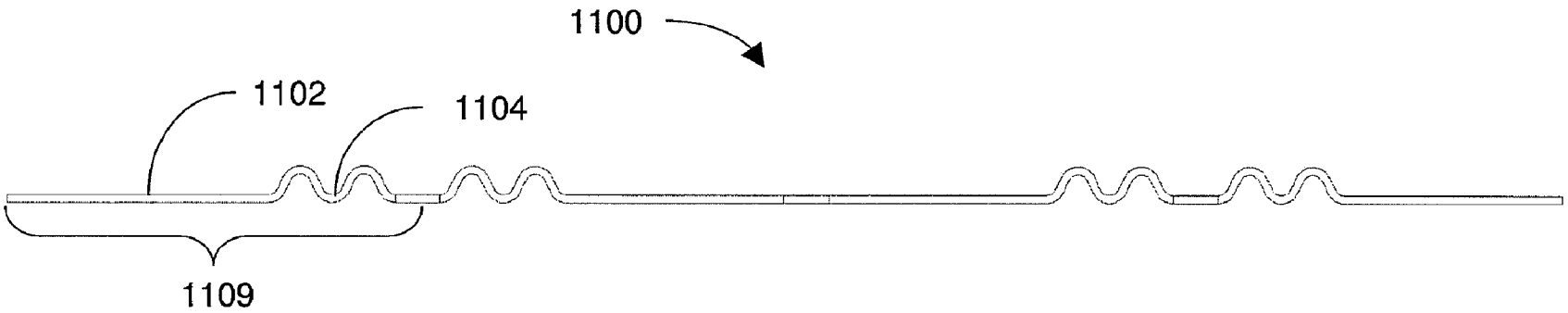
FIGS. 10*a* and 10*b* are side views of a continuous wireform with curved regions formed according to one illustrative embodiment.
Figure 10B:
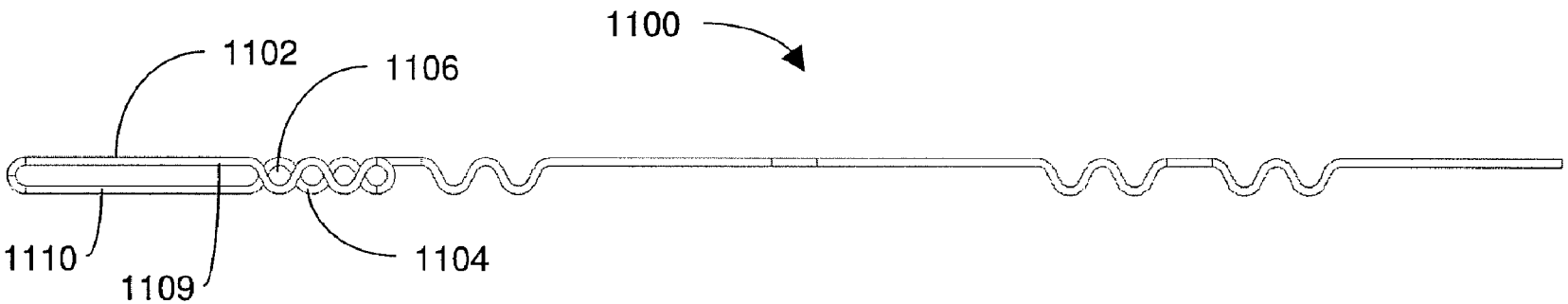

FIGS. 10*a* and 10*b* depict another illustrative embodiment of a process where the continuous wire 1100 may be formed out of a single conductive wire. In this regard, shapes are formed first and the wire is subsequently wrapped.

FIG. 10*a* shows a plan view of curved regions 1104 of the wire along with elongated regions 1102 where the curved regions 1104 are formed by any suitable technique. In some embodiments, a curved regions 1104 may be formed through rolling around a mandrel or a number of mandrels. In other embodiments, a curved region 1104 may be formed through use of an appropriate bending tool, machine, or combination thereof. In this aspect, FIG. 10*a* shows one portion 1109 of a section.

FIG. 10*b* depicts a plan view of portion 1109 aligned with portion 1110 to form a segment with passageways 1106 that run through curved regions 1104 of the portions. In this aspect, portion 1110 may be curved around to substantially align with portion 1109 as desired in any suitable manner. In various embodiments, one portion may be curved around to align with another portion through rolling around a mandrel. In other embodiments, one portion may be curved around to align with another portion through use of an appropriate bending tool, machine, or combination thereof.

Figure 10C:
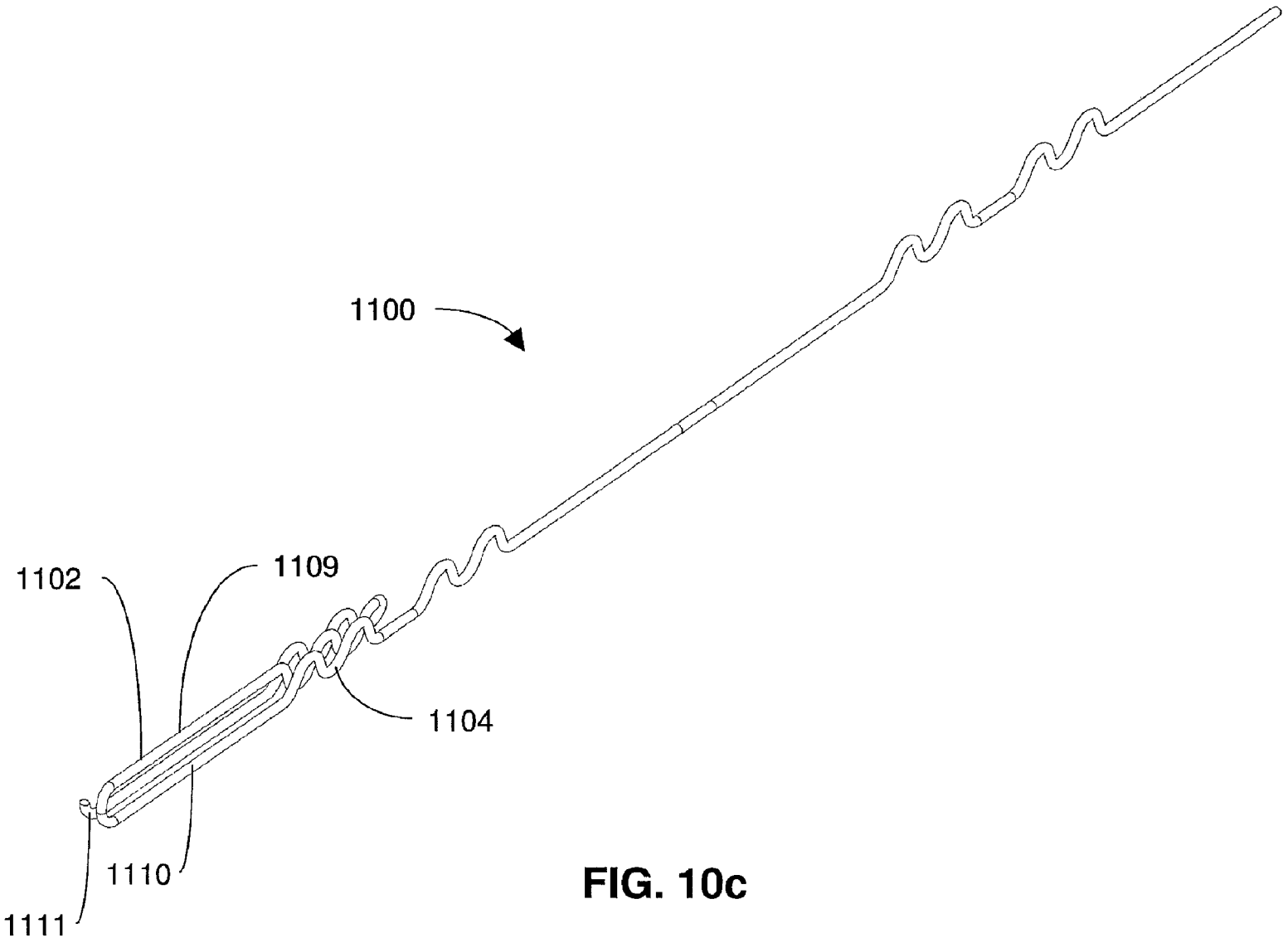
FIG. 10*c* is a perspective view of the continuous wireform of FIG. 10*b;*

FIG. 10*c* depicts a perspective view of a third portion 1111 aligned with portions 1109 and 1110 to further lengthen passageways 1106 that run through curved regions 1104 of the portions. Similar to that described above, portion 1111 may be curved around to substantially align with portions 1109 and 1110 as appropriately desired. In this regard, it can be seen that other portions of continuous wire 1100 may be curved in such as fashion to align portions suitably adjacent to one another. In various embodiments, the process of bending continuous wire 1100 using suitable techniques may be repeated as desired to form a continuous wire 1100 that is planar as shown in FIG. 9*a*. A longitudinal offset may also be provided as desired according to that shown in FIG. 9*c*.

In yet another illustrative embodiment for forming a continuous wire 1100 out of a single conductive wire, the wire may be wrapped first and then shapes can be formed in any suitable fashion. In this respect, a long wire may be wound according to the length desired for each of the sections. Once the wire is bent such that portions are appropriately positioned adjacent to one another, curved regions are suitably formed such that passageways may be formed accordingly. In various embodiments, any appropriate tool, machine, or combination thereof may be used to form the curved regions within the portions of wire.

In different aspects, continuous wire 1100 may be made out of any suitable conductive material. In some embodiments, continuous wire 1100 may be formed out of soft copper, beryllium copper alloy, or any other appropriate form of copper. In other embodiments, continuous wire 1100 may be formed out of any other material with suitable ductility and conductivity properties such as, but not limited to, platinum, lead, tin, aluminum, silver, carbon, gold, or any combination or alloy thereof, and the like.

In other aspects of the present invention, the continuous wire 1100 may be rolled into a substantially cylindrical shape for insertion into a ferrule 1302. In some embodiments, continuous wire 1100 may be wrapped around a mandrel so as to be shaped in a suitably cylindrical fashion. In other embodiments, continuous wire 1100 may be placed within a tube so as to be shaped in a suitably cylindrical manner. In further embodiments, as a biasing element may be positioned within passageways in the continuous wire so as to provide enhanced contact between the connector wire and the ferrule, the biasing element may also contribute to formation of the continuous wire 1100 into a shape having a substantially cylindrical profile.

It should be appreciated that the wire forming techniques employed to manufacture the continuous wireform shown and described herein may not necessarily produce a flat wireform as shown in FIG. 9*a*. Instead, the various manufacturing processes chosen may impart an arc or curl on the wireform. Subsequent processing of the wireform can either flatten the wireform to resemble that shown in FIG. 9*a* or further curve it into a round connector. Thus, this further processing may minimize the impact of such a manufacturing issue.

As discussed above and as discussed in the above referenced U.S. Patent Application Publication No. 2004/0214454, the conductive wires may be woven with a non-conductive loading fiber that is subsequently tensioned to create a contact force on the wire segments. However, the present invention is not limited in this regard as other suitable arrangements for biasing the wire segments into contact with the mating surface may be employed. Thus, in further aspects, one or more biasing elements may be placed within passageways formed from the conductive wire in order to allow for enhanced connective properties. Biasing elements may provide a normal contact force on the conductive wire once it is mated to another connection element, thus, as will be explained below, the biasing element can be a self-contained loading element wherein the biasing element itself provides a spring force on the conductive wire providing the appropriate mating contact force on the mating connector. Thus, as used herein, a "loading element" refers broadly to any element that alone or in combination with other elements can bias the conductive wire, whereas a "biasing element" refers to an element that itself can impart a bias on the conductive wire. In this sense, then, a loading element may include a biasing element.

In different embodiments, the biasing element may be made from any suitable material, such as, but not limited to any combination of steel, stainless steel, beryllium copper, phosphor bronze, nitinol, plastic, and/or any other appropriate material. In other embodiments, a biasing element may be made as a spring that, once deformed, returns elastically back to its original shape. The biasing element may be positioned in one or more passageways of the continuous wire 1100 such that a bias force may facilitate outer areas of the wire to come into suitable contact with a mating surface of a connector when a connection is made.

In further embodiments, a biasing element that is made as a spring may incorporate varying spring constant rates that directly affect the degree of elasticity for the spring. In this regard, it may be desirable for spring constant rates to vary along each passageway 1106 of the continuous wire 1100. As a non-limiting example, it may be desirable for the tension of the most exterior passageway 1106 of the continuous wire 1100 furthest from the ferrule 1302 to have less tension than the passageway 1106 of the continuous wire 1100 closest to the ferrule 1302. In this regard, with varying degrees of spring constant rates, which may lead to varying degrees of tension in passageways 1106 of the continuous wire 1100, connections may be more easily facilitated. Yet as connections are made easier, the quality of connection, mechanically and/or electrically, does not have to be sacrificed.

As described above, the shape of the continuous wire 1100, for example the diameter of passageways, may vary at different regions. In this respect, although not necessarily so, tension provided by a spring biasing element may be varied such that shapes of passageways may be affected as desired.

In one illustrative embodiment of the present invention, one or more clips may be used as a biasing element in the electrical connector, providing for improved connection contacts to be made. In this respect, clips may have a substantially arcuate shape so as to complement the cylindrical aspect of the continuous wire 1100. In another aspect, ends of the clips may be turned back so that the clips are sufficiently held in place once inserted within passageways of the continuous wire 1100. In yet a different aspect, any desired number of clips may be inserted through passageways of the continuous wire 1100. In a non-limiting example, a clip may be inserted into each passageway of the continuous wire 1100.

Figure 11A:
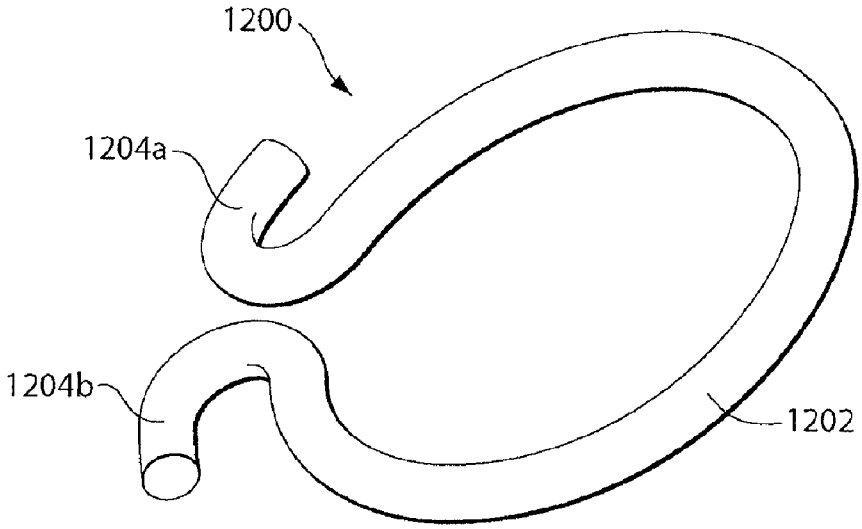
FIG. 11*a* is a perspective view of a loading element according to one illustrative embodiment.
Figure 11B:
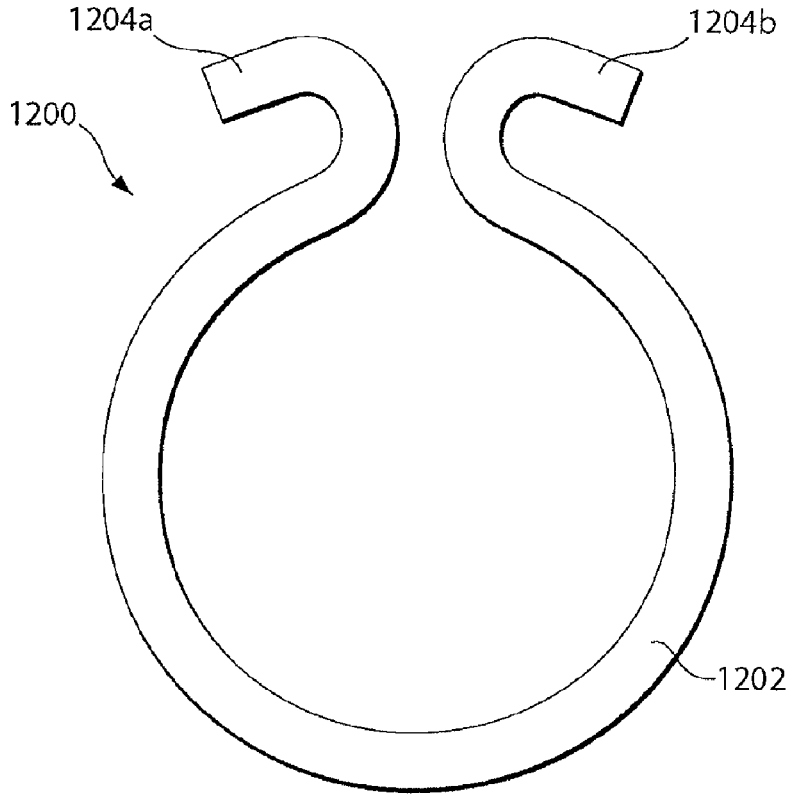
FIG. 11*b* is a plan view of the loading element of FIG. 11*a;*

FIGS. 11*a* and 11*b* depict a clip 1200 shown in perspective and plan views. In the embodiment shown, clip 1200 has an arcuate portion 1202 that includes two separate ends 1204*a* and 1204*b*. In some embodiments, separate ends 1204*a* and 1204*b* may be bent back in a hook-like fashion, as depicted in FIGS. 11*a* and 11*b*, allowing for the clip 1200 to remain secure within a passageway 1106 of the continuous wire 1100. In other embodiments, separate ends 1204*a* and 1204*b* may be blocked off so that the clip 1200 remains secure within a passageway 1106. In this regard, separate ends 1204*a* and 1204*b* may take on the form of a cap in the shape of a pin head, a ball, or any other suitable form. In one example, once it is desired for separate ends 1204*a* and 1204*b* to be capped, it may be possible for a cap to be physically attached to the ends in an appropriate manner. In another example, it may be possible for heat and/or other suitable radiation to be used in forming an aggregate from separate ends 1204*a* and 1204*b*. In this regard, heat may cause one of the ends to become molten and ball up, acting as a suitable capping element. It may also be possible for separate ends 1204*a* and 1204*b* to be bent back and capped in combination.

In other embodiments of a clip 1200, separate ends 1204*a* and 1204*b* are not bent back or capped at all, but remain separate. In even more embodiments, once a clip 1200 is inserted into the continuous wire 1100 it may be possible to fuse the separate ends together into a continuous band.

In illustrative embodiments of the present invention, clips 1200 may be placed within passageways 1106 of the continuous wire 1100 and the clip-wire assembly may be appropriately inserted into a connection ferrule. Alternatively, the continuous wire 1100 may be inserted into the connection ferrule, and the clips 1200 may subsequently be inserted through the passageways 1106. It should also be understood that any desired number of clips may be used with the continuous wire 1100 and in any suitable combination. In an exemplary embodiment, shown in FIG. 7*a*, each passageway of the continuous wire 1100 may have a single clip inserted throughout. In other examples, multiple clips may be inserted into a single passageway, or passageways may be left unfilled without a clip.

In other aspects of the present invention, clips 1200 may be a part of the process for the continuous wire 1100 to be formed into a substantially cylindrical shape. In some embodiments, substantially arcuate clips 1200 may be fed into passageways 1106 of the continuous wire 1100. In this regard, insertion ends of the clips may be bent back after the clips are suitably situated within passageways of continuous wire 1100. In other embodiments, clips may begin relatively straight in shape and inserted into passageways of continuous wire 1100. In this regard, insertion ends of the clips are bent back only after proper positioning into passageways is performed. Once the clips are fully inserted into the passageways, the clips may then be formed into a substantially arcuate shape along with the continuous wire 1100. It should be understood that any desired number of clips may be inserted into passageways of the continuous wire 1100, simultaneously and/or subsequently, as desired. Once the assembly of clips and continuous wire 1100 are suitably formed, then the insertion ends of the clips may be bent back or shaped accordingly.

Figure 12:
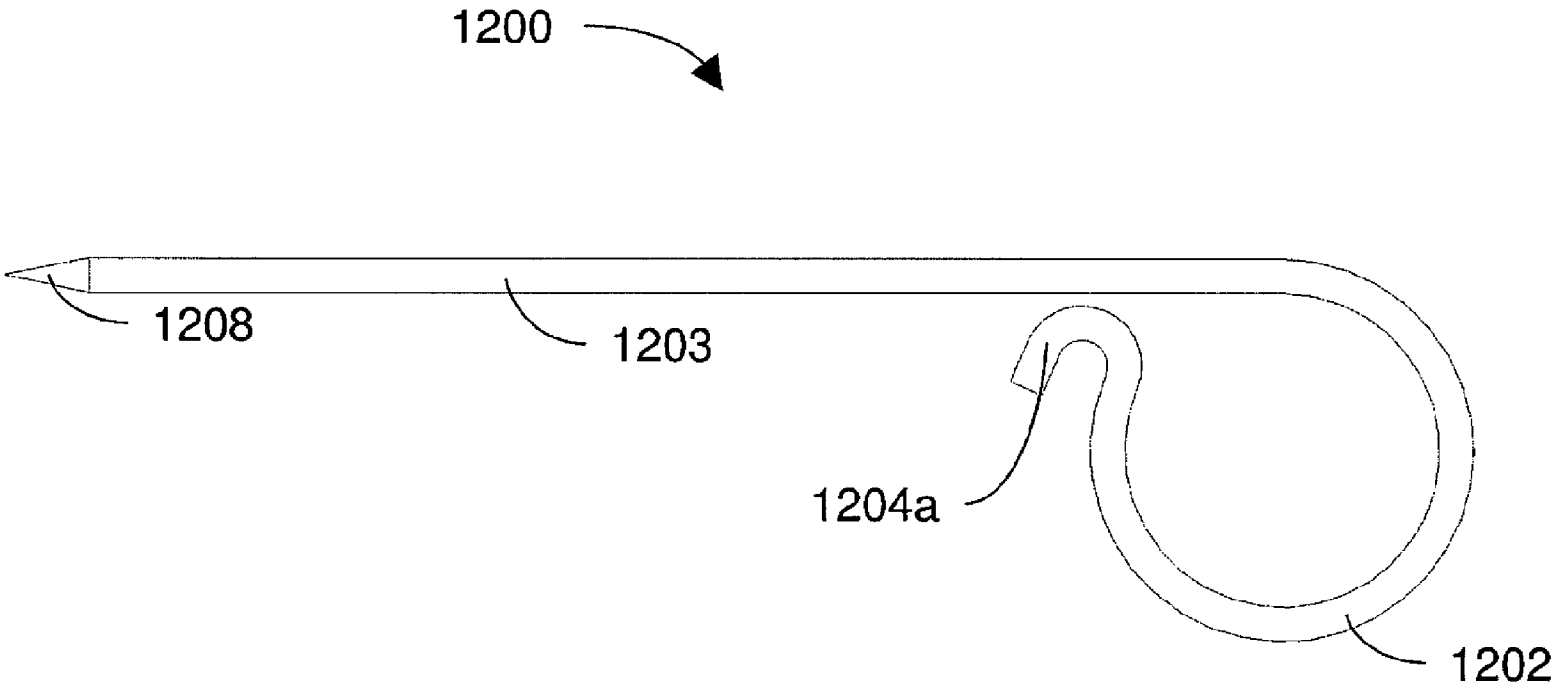
FIG. 12 is a plan view of a loading element according to another illustrative embodiment.

FIG. 12 depicts one illustrative embodiment of a clip 1200 that may be inserted into passageways 1106 of the continuous wire 1100. In this regard, clip 1200 includes a separate end 1204*a* that contains a bent back hook and an arcuate region 1202 much like that depicted in FIGS. 11*a* and 11*b*. For insertion into passageways 1106 of continuous wire 1100, a straight region 1203 and an insertion end 1208 are provided. For assembly, as the insertion end 1208 is positioned through any suitable passageway 1106 of continuous wire 1100, clip 1200 may slide through the passageway 1106 with the shape of continuous wire 1100 conforming to the arcuate profile of region 1202. In the embodiment shown, once the insertion end 1208 is fully through and the passageway is suitably positioned along the arcuate region 1202, straight region 1203 may be trimmed off such that another separate end similar to that of end 1204*a* may arise. As a result, the new end may be bent accordingly or could be subject to an appropriate capping treatment as described previously. In various embodiments, multiple clips 1200 may be inserted into passageways of continuous wire 1100 simultaneously.

Figure 13:
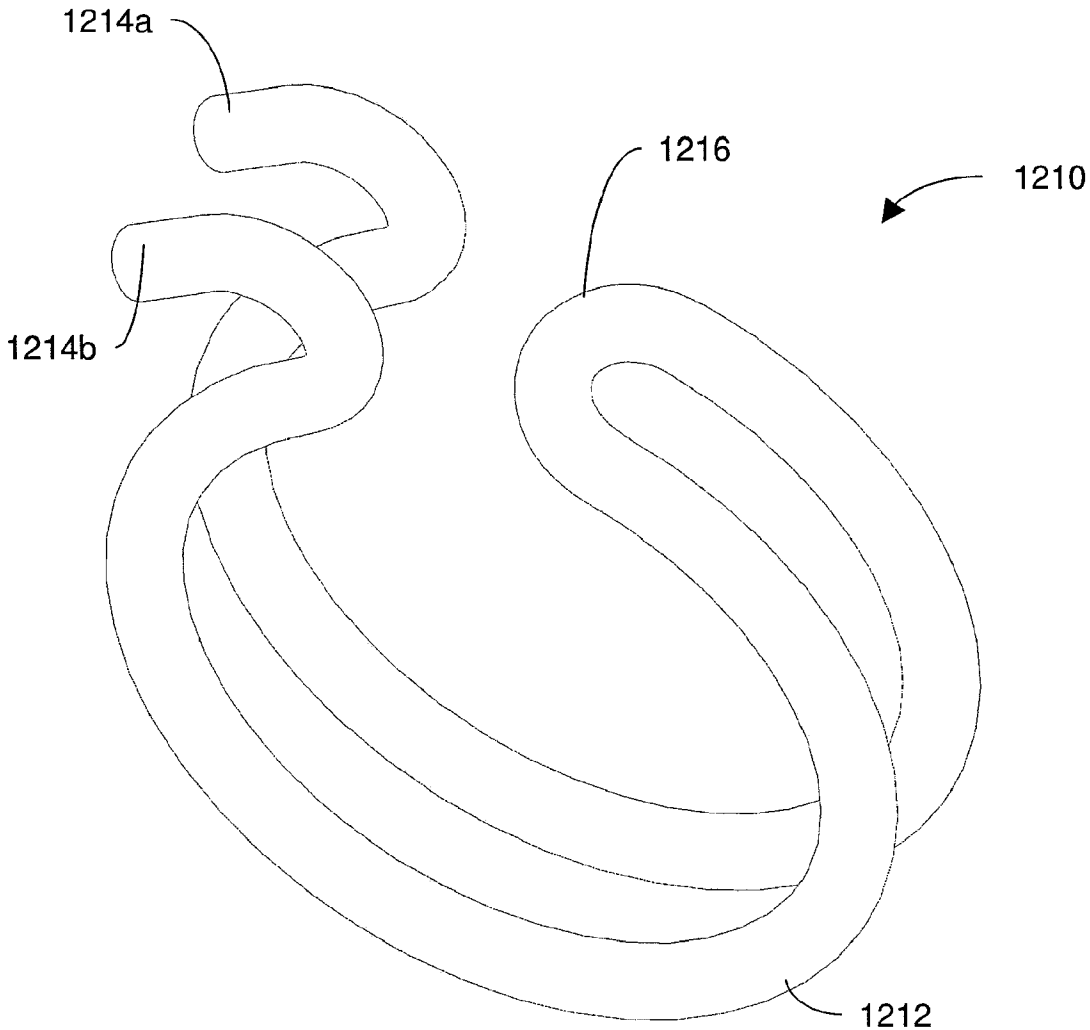
FIG. 13 is a perspective view of a dual loading element according to another illustrative embodiment.

FIG. 13 shows a further illustrative embodiment of a biasing element formed as a dual clip 1210, where two clips are effectively connected together. As depicted, the dual clip 1210 has separate ends that are bent back similarly as clip 1200, but a connection is made between two clips at a connection region 1216. It should be understood that the dual clip 1210 is not limited to that shown in FIG. 13, as the ends of the clips may be capped, may be fused together, do not have to be bent back, or any combination thereof, similarly to that of clip 1200.

Figure 14:
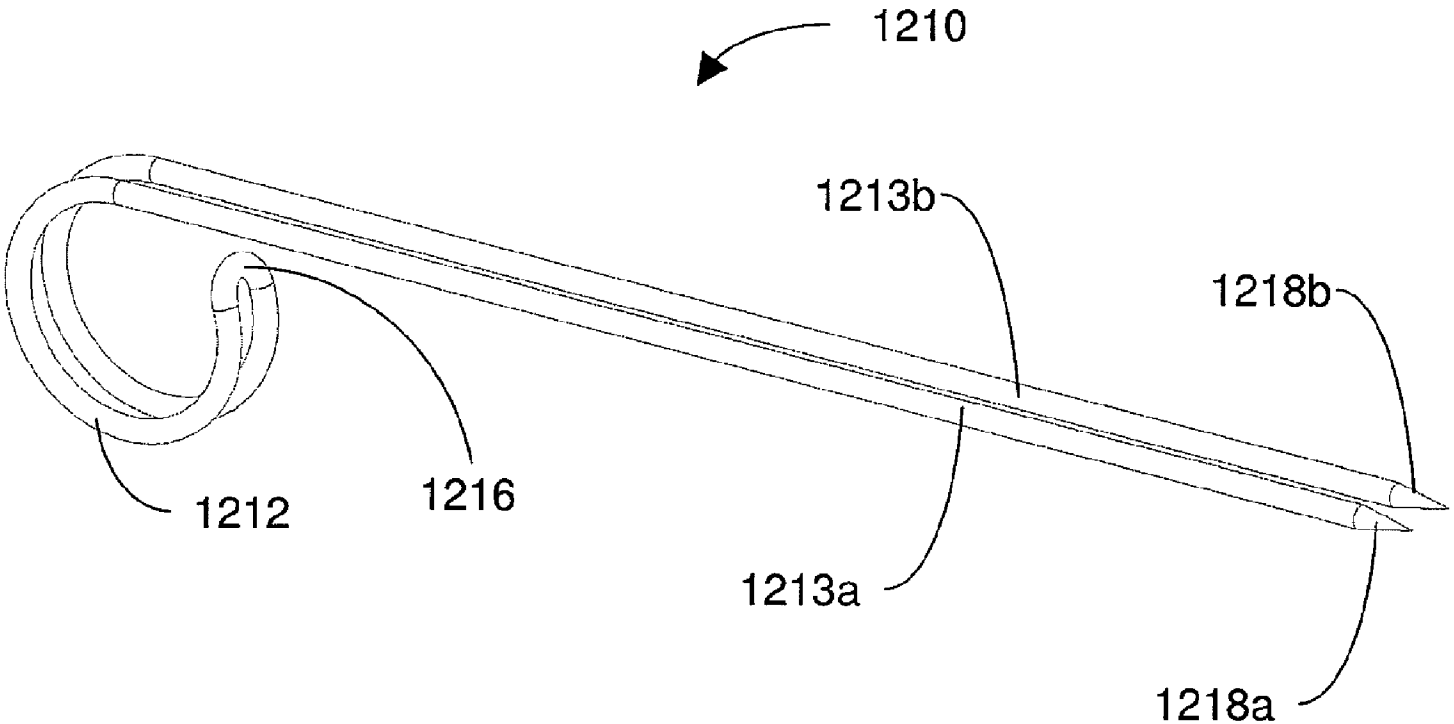
FIG. 14 is a perspective view of a dual loading element according to another illustrative embodiment.

Similar to that of clip 1200, FIG. 14 shows that dual clip 1210 may also be inserted into passageways 1106 of continuous wire 1100. In this regard, dual clip 1210 would typically be inserted into two passageways 1106 simultaneously for each dual clip 1210. Herein, connection region 1216 joins two arcuate regions 1212 together, extending into straight regions 1213*a* and 1213*b*, and eventually giving rise to insertion ends 1218*a* and 1218*b*. To assemble, insertion ends 1218*a* and 1218*b* are positioned through respective passageways 1106 of continuous wire 1100 and may be slid through such that the shape of continuous wire 1100 conforms to the arcuate profile of region 1212. Once the passageways are appropriately positioned along arcuate region 1212, straight regions 1213*a* and 1213*b* may be trimmed off to a suitable length complementing connection region 1216. The new end may then be bent accordingly or could be subject to an appropriate capping treatment as described previously. In some embodiments, multiple dual clips 1210 may be inserted into passageways of continuous wire 1100 simultaneously.

In another illustrative embodiment of the present invention, a helical coil 1250 may be used as a biasing element in the electrical connector. In this respect, the coil 1250 may have a substantially arcuate shape similar to that of clips 1200 and 1210 described above so as to complement the cylindrical aspect of the continuous wire 1100. Indeed, for some embodiments, a longer clip may be used and formed into helical coil 1250 such that a longitudinal offset exists upon a 360 degree rotation of the coil. In the same regard, ends of a coil may be turned back so that the coil may be sufficiently held in place once inserted within passageways of the continuous wire 1100. In yet a different aspect, any desired number of coils may be inserted through passageways of the continuous wire 1100, typically one after another.

Figure 15:
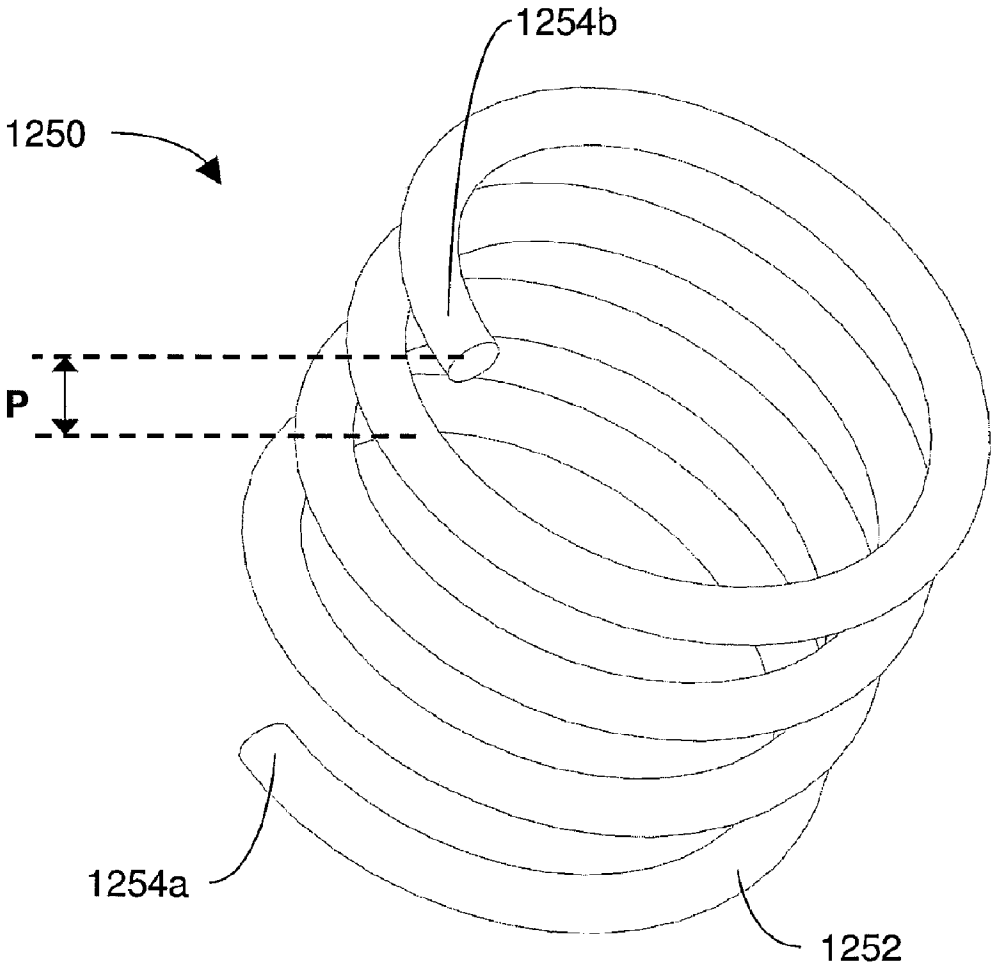
FIG. 15 is a perspective view of a helical loading element according to one illustrative embodiment.

FIG. 15 shows a helical coil 1250 according to one embodiment of the present invention. As shown, a pitch exists in the arcuate region 1252 that offsets the coil any appropriate longitudinal distance P. In other aspects, separate ends 1254*a* and 1254*b* are provided, either of which may be inserted through passageways of the continuous wire 1100. Although not shown in FIG. 15, it is possible for either or both of the separate ends 1254*a* and/or 1254*b* to be bent back or capped, as described above for embodiments that includes clips.

In various illustrative embodiments of the present invention, coils 1250 may be placed through passageways 1106 in the continuous wire 1100 and the coil-wire assembly may be appropriately inserted into a connection ferrule 1302. In this regard, as the helical coil 1250 is inserted into passageways of the continuous wire 1100, the continuous wire 1100 would conform to the pitch of the helical coil 1250, having a longitudinal offset distance P. It should be understood that any desired number of coils 1250 may be used with the continuous wire 1100 in any suitable combination. In some embodiments, one passageway of the continuous wire 1100 may have a single coil inserted throughout as desired. In other embodiments, multiple passageways of continuous wire 1100 may have multiple coils inserted throughout as desired.

In further aspects, a helical coil 1250 may contribute to the process of forming the continuous wire 1100 into a substantially cylindrical shape. In some embodiments, the continuous wire 1100 starts out in a substantially planar configuration and an insertion end of the helical coil 1250 enters a passageway 1106 of the continuous wire 1100. In this regard, the helical coil 1250 may then be twisted on to the continuous wire 1100 in a screw fashion such that the wire winds around according to the pitch of helical coil 1250. In other embodiments, an insertion end of the helical coil may enter the entrance of a passageway in the continuous wire 1100 and the continuous wire 1100 may be pushed on to the helical coil 1250 such that the wire winds around according to the pitch of the helical coil 1250. Indeed, a combination of twisting the helical coil 1250 and pushing the continuous wire 1100 on to the helical coil 1250 may be implemented together. Once the helical coil 1250 is fully inserted into the continuous wire 1100, the insertion end of the coil may be bent back and/or capped as desired, similarly to that described above for the clips.

In more aspects of the present invention, a ferrule 1302 may be provided for a more secure connection to be made. In this regard, the conductive wire 1100 may have a mating region that comes into contact with a ferrule 1302 in a manner that provides a strong mechanical and electrical connection. The elongated region 1102 of the continuous wire 1100 may be connected to a ferrule 1302, as shown in FIGS. 7*a* and 7*b*, in any suitable manner. In this regard, the elongated portion 1102 may be firmly attached to the ferrule 1302 so as to form a secure mechanical attachment along with having a well suited electrical connection. In some embodiments, solder paste may also be used as added material in providing for an enhanced connection. In other embodiments, a crimping mechanism may be utilized in order to minimize extraneous movement of any parts once the connection is made. In further embodiments, a clamp may be used from an outside tool in order to make the connection more firm.

Figure 16:
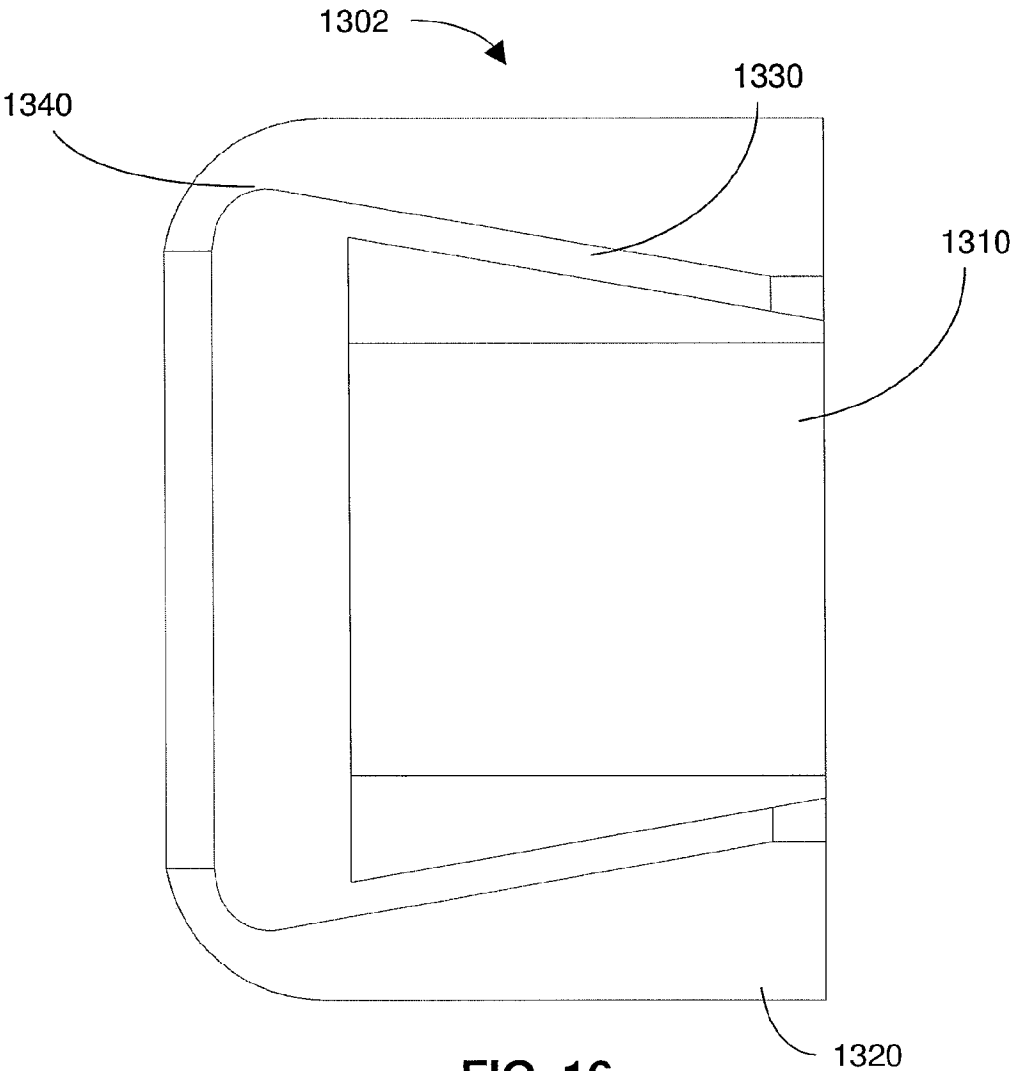
FIG. 16 is a cross-sectional view of an end of the connector.

FIG. 16 shows an illustrative embodiment of a ferrule 1302 that includes an inner ferrule 1310 and an outer ferrule 1320. In between the inner ferrule 1310 and the outer ferrule 1320 is located a ferrule passage 1330 through which an elongated region 1102 of continuous wire 1100 may enter to create a connection. In the embodiment depicted in FIG. 16, inner ferrule 1310 and outer ferrule 1320 are slanted to form an angle upon entrance of the wire 1100 into the ferrule passage 1330. In this respect, the mating surface of the elongated region 1102 may slide through the passage 1330 defined by the inner ferrule 1310 and the outer ferrule 1320 at the angle such that the diameter of the elongated region 1102 may increase. At the end of the passage 1330, the outer ferrule 1320 extends out further than the inner ferrule 1310. Once the elongated region 1102 reaches over the end of the inner ferrule 1310 but not further than the extension of the outer ferrule 1320, the back end 1340 of the outer ferrule 1320 may be bent over toward the inner ferrule 1310 in a manner such that the elongated region 1102 of the wire may be firmly connected in a crimped attachment as the wire 1100 may be caught by the connection between the outer ferrule 1320 curving over the inner ferrule 1310. In some embodiments, pressure is applied to the back end of outer ferrule 1320 and the elongated region 1102 of the wire 1100 for a crimping mechanism to occur. It should be understood that it is not requirement of the present invention for the inner ferrule 1310 to form an angled passage 1330 with outer ferrule 1320.

In another embodiment, solder may be used to aid the mechanical and electrical attachment of elongated region 1102 of a cylindrical continuous wire 1100 that may be inserted into a ferrule 1302. In this regard, the wire 1100 may be inserted through a passage 1330 formed by an inner ferrule 1310 and an outer ferrule 1320 through which the elongated region 1102 of the wire 1100 may slide and molten solder may be spread throughout the passage 1330. In some embodiments, once the elongated region 1102 slides straight through the passage by an appropriate insertion distance, molten solder may be applied evenly to the passage to allow the elongated region 1102 to be electrically connected and mechanically attached to the ferrule passage 1330. As the solder is then allowed to cool, the connection may result in a strong mechanical and electrical attachment.

In other embodiments, a crimping mechanism, in the form of press tool application or other suitable method, may be applied on the outer ferrule on any appropriate side in bringing together the wire-ferrule assembly so as to make the connection between the elongated region 1102 and the ferrule 1302 more secure. In some embodiments, pressure from an outside tool may be applied from the back end of the outer ferrule 1320. In other embodiments, pressure from an outside tool may be applied from the outer edges of the outer ferrule 1320.

It should be understood that there several ways in which the elongated region 1102 of the continuous wire 1100 may mate suitably well with the ferrule 1302. Indeed, a combination of the techniques described could be used. As a non-limiting example, a passage 1330 made by inner ferrule 1310 and outer ferrule 1320 may be formed at an angle and molten solder may be added in addition to crimping by any appropriate pressure applying mechanism. Indeed, it is also not a necessary requirement for any of the techniques described to be used for the elongated region 1102 of the continuous wire 1100 to be connected to the ferrule in a suitable manner.

It should be appreciated that although the above-illustrative embodiments include combinations of the various described features, the present invention is not limited in this regard as any feature(s) described herein may be employed in any suitable combination. Thus, for example, the connector formed with a continuous wire may be employed with either spring elements or a non-conductive loading band that are subsequently tensioned with a tensioning element, as the present invention is not limited in this regard.

It is to be understood that the invention is not limited in its application to the details of construction and the arrangement of components set forth in the following description or illustrated in the drawings. Other embodiments and manners of carrying out the invention are possible. Also, it is to be understood that the phraseology and terminology used herein is for the purpose of description and should not be regarded as limiting. The use of "including," "comprising," or "having" and variations thereof is meant to encompass the items listed thereafter and equivalents thereof as well as additional items. In addition, it is to be appreciated that the term "connector" as used herein refers to each of a plug and jack connector element and to a combination of a plug and jack connector element, as well as respective mating connector elements of any type of connector and the combination thereof. It is also to be appreciated that the term "conductor" refers to any electrically conducting element, such as, but not limited to, wires, conductive fibers, metal strips, metal or other conducting cores, etc.

Having thus described various illustrative embodiments and aspects thereof, modifications and alterations may be apparent to those of skill in the art. Such modifications and alterations are intended to be included in this disclosure, which is for the purpose of illustration only, and is not intended to be limiting. The scope of the invention should be determined from proper construction of the appended claims, and their equivalents.

What is claimed is:

1. An electrical connector comprising:

a conductive wire defining a plurality of adjacent sections including a first section and an adjacent second section, the first section having a first portion of the first section comprising a plurality of peaks and valleys and a second portion of the first section continuous with the first portion of the first section comprising a plurality of valleys and peaks, the second portion of the first section is looped back adjacent the first portion of the first section whereby the plurality of peaks and valleys of the first portion of the first section align with the plurality of valleys and peaks, respectively, of the second portion of the first section to define a plurality of passageways in the first section of a plurality of sections, wherein the plurality of sections are disposed about a circumference to form a substantially cylindrical shape and wherein adjacent sections are longitudinally offset from one another such that each of the passageways of one section are offset from each of the passageways of an adjacent section; and a helically shaped biasing element disposed within the plurality of passageways to radially bias a plurality of peaks into contact with a mating connector when connected thereto.

2. The electrical connector of claim 1, wherein the biasing element biases the conductive wire over a revolution that is greater than 360°.

3. The electrical connector of claim 1, wherein the biasing element comprises a spring coil.

4. An electrical connector comprising:

a conductive wire defining a plurality of adjacent sections including a first section and an adjacent second section, the first section having a first portion of the first section comprising a plurality of peaks and valleys and a second portion of the first section continuous with the first portion of the first section comprising a plurality of valleys and peaks, the second portion of the first section is looped back adjacent the first portion of the first section whereby the plurality of peaks and valleys of the first portion of the first section align with the plurality of valleys and peaks, respectively, of the second portion of the first section to define a plurality of passageways in the first section of a plurality of sections, wherein the plurality of sections are disposed about an arc circumference to form a substantially arcuate shape having the plurality of passageways disposed about an arc; and an arcuate shaped biasing element disposed within adjacent passageways to bias a plurality of peaks into contact with a mating connector when connected thereto, said arcuate shaped biasing element comprising a radially-biasing spring clip.

5. The electrical connector of claim 4, further comprising a plurality of arcuate shaped biasing elements.

6. The electrical connector of claim 4, wherein the arcuate shaped biasing element has two separate ends, each end compromising a bend to at least loosely secure the arcuate shaped biasing element within the passageways.

7. The electrical connector of claim 4, wherein the biasing element is substantially planar.

* * * * *

UNITED STATES PATENT AND TRADEMARK OFFICE

CERTIFICATE OF CORRECTION

PATENT NO. : 7,547,215 B1
APPLICATION NO. : 12/023950
DATED : June 16, 2009
INVENTOR(S) : Gregory Mark and Andrew Wallace It is certified that error appears in the above-identified patent and that said Letters Patent is hereby corrected as shown below:

At col. 20, lines 35-36, delete the word "compromising" and insert in its place the word --comprising--.

Signed and Sealed this

Eighteenth Day of August, 2009

David J. Kappos

David J. Kappos
*Director of the United States Patent and Trademark Office*